US009003848B2

(12) United States Patent
Bammer et al.

(10) Patent No.: US 9,003,848 B2
(45) Date of Patent: Apr. 14, 2015

(54) DEVICE AND METHOD FOR BENDING A WORKPIECE

(75) Inventors: Ferdinand Bammer, Vienna (AT); Dieter Schuoecker, Vienna (AT); Bernhard Holzinger, Vienna (AT); Joachim Aichinger, Ansfelden (AT); Gerhard Sperrer, Oberschlierbach (AT); Thomas Schumi, Vienna (AT)

(73) Assignee: TRUMPF Maschinen Austria GmbH & Co., KG., Pasching (AT)

( * ) Notice: Subject to any disclaimer, the term of this patent is extended or adjusted under 35 U.S.C. 154(b) by 568 days.

(21) Appl. No.: 13/381,193

(22) PCT Filed: Jun. 28, 2010

(86) PCT No.: PCT/AT2010/000235

§ 371 (c)(1), (2), (4) Date: Mar. 15, 2012

(87) PCT Pub. No.: WO2011/000011

PCT Pub. Date: Jan. 6, 2011

(65) Prior Publication Data

US 2012/0167649 A1 Jul. 5, 2012

(30) Foreign Application Priority Data

Jun. 29, 2009 (AT) ..... A 1011/2009

(51) Int. Cl.
*B21D 37/16* (2006.01)
*B21D 5/02* (2006.01)

(52) U.S. Cl.
CPC ..... *B21D 37/16* (2013.01); *B21D 5/0209* (2013.01)

(58) Field of Classification Search
CPC ..... B21D 37/16; B21D 5/00; B21D 5/02; B21D 5/0209; B23K 26/0738; B21K 29/00; B21J 1/06
USPC ..... 72/342.1, 389.3
See application file for complete search history.

(56) References Cited

U.S. PATENT DOCUMENTS 3,740,996 A * 6/1973 Hix ..... 72/461
4,550,586 A 11/1985 Aubert et al.

(Continued)

FOREIGN PATENT DOCUMENTS

AT 411 023 9/2003
DE 195 14 285 6/1996

(Continued)

OTHER PUBLICATIONS

International Search Report of PCT/AT2010/000237, Oct. 12, 2010.

(Continued)

*Primary Examiner* — Teresa M Ekiert
(74) *Attorney, Agent, or Firm* — Collard & Roe, P.C.

(57) ABSTRACT

The invention relates to a bending die (3), particularly a V-shaped die (13), comprising a tool base body (7) with a contact surface (10) for contacting the workpiece (2) to be bent by a bending punch (5), a groove-shaped bending recess (11) in the contact surface (10) and at least one beam exit opening (17) in the bending recess (11) and extending along thereof, which is configured to discharge high-energy radiation (18) onto a workpiece (2) bearing against the contact surface (10) in order to heat the deformation zone of the workpiece (2). An arrangement of diode laser bars (20) is fixed in the interior of the tool base body (7) for producing the radiation (18). Said diode laser bars (20) are arranged at least approximately uniformly along the longitudinal direction (27) of the bending recess (11) behind the beam exit opening (17) in the tool base body (7).

32 Claims, 6 Drawing Sheets

(56) References Cited

U.S. PATENT DOCUMENTS

| | | | |
|---|---|---|---|
| 5,359,872 | A | 11/1994 | Nashiki |
| 6,251,328 | B1 | 6/2001 | Beyer et al. |
| 6,415,639 | B1 | 7/2002 | Kilian et al. |

FOREIGN PATENT DOCUMENTS

| | | |
|---|---|---|
| EP | 0 108 718 | 5/1984 |
| EP | 0 993 345 | 4/2000 |
| EP | 1 961 502 | 8/2008 |
| JP | 1-233019 | 9/1989 |
| JP | 2-280930 | 11/1990 |
| JP | 5-096329 | 4/1993 |
| JP | 2003-311331 | 11/2003 |
| JP | 2004-034074 | 2/2004 |

OTHER PUBLICATIONS

English Translation of International Preliminary Report on Patentability and Written Opinion of the International Searching Authority in PCT/AT2010/000235, Jan. 17, 2012.

* cited by examiner

DEVICE AND METHOD FOR BENDING A WORKPIECE

CROSS REFERENCE TO RELATED APPLICATIONS

This application is the National Stage of PCT/AT2010/000235 filed on Jun. 28, 2010, which claims priority under 35 U.S.C. §119 of Austrian Application No. A 1011/2009 filed on Jun. 29, 2009. The international application under PCT article 21(2) was not published in English.

The invention relates to a bending die and a die arrangement as well as a method with an application of a bending die according to the invention or a die arrangement according to the invention.

The bending of workpieces has for a long time been a frequently applied and reliable method for processing workpieces by reshaping. The scope of application of bending processes is frequently limited by material properties, especially by the mechanic-technological properties. The problem concerning brittle materials like magnesium, titanium, spring steels, high-strength aluminum-alloys, high-strength steels or other materials known to be brittle is that in case of a deforming by bending, these materials do not provide sufficient plastic formability and thus other undesired deformations appear. A parameter that can indicate the respective behavior of materials is the so-called ultimate strain that means the value of the plastic deformation that a workpiece to be deformed can bear until it breaks. An alternative parameter for this behavior is also the so-called yield strength to tensile strength ratio hat considers the tension required in a workpiece at the beginning of a noticeable plastic deformation in relation to the tension within the workpiece in case of breaking load.

In order to make such materials having a low ultimate elongation or a high elasticity ration accessible to the application of a deformation methods, especially to bending, methods putting the workpiece into a condition providing more favorable mechanic characteristics and enabling it to be deformed by means of a bending method have been applied for a while. A known method is heating the workpiece to be bent at least in the region of the deformation zone, with the result that in this heated area the tension necessary for initiating of plastic deformation can be reduced.

As an example of such a method, the EP 0 993 345 A1 discloses a method for bending a workpiece by application of mechanic force under selective heating of the workpiece along a bending line by means of laser radiation, where one laser beam or several laser beams are formed to be an elongate radiation field and where a heating zone along the bending line of the workpiece is created by the radiation field. In this case, the device for forming the linear radiation field comprises cylindrical lenses and/or cylindrical mirrors, which are used to guide a radiation field through the opening in the bending die to the workpiece. In the exemplary embodiment according to FIG. 4 of the EP-A1, a laser beam is split into two radiation fields by means of a beam forming optic, which consists of a prism mirror, two cylindrical lenses and two cylindrical passive deflectors. The two radiation fields are guided through the bending die onto the workpiece and produce respective linear heating zones. The laser beam deformed this way is thus guided to the workpiece through a slot-like opening in the bottom side of the die.

This solution for the guiding of high-energy radiation in a bending die known from the EP 0 993 345 A1 is not ideally suited for the practical application with common bending machines, because the bending die provides a limited mechanical stability due to its two-piece embodiment and the press beam receiving the bending die would have to provide recesses for the beam distribution arrangement. Furthermore, such a distribution of the radiation requires a high quality of the optical elements for a most even possible distribution of the radiant power of the radiation source into the deformation zone of the workpiece.

The object of the invention is to provide a bending die that is applicable to a bending method according to its genre, which is better applicable for practical application.

The object is achieved by a bending die according to one aspect of the invention or a die arrangement according to another aspect of the invention.

Due to the fact that for the production of the radiation an arrangement of diode laser bars is fixed within the tool base body and the diode laser bars are arranged at least approximately evenly along the longitudinal direction of the bending recess behind the beam exit opening in the tool base body, the high-energy radiation necessary for the heating of the workpiece is produced closely and evenly relating to the deformation zone to be heated. Thus, complex optical elements for deflecting, splitting and forming of a concentrated radiation beam provided by the radiation source are omitted. Particularly the splitting of a concentrated radiation beam into radiation beam portions with at least approximately similar radiation performances requires a connection of en external radiation source and high-quality optical component parts that are cost-intensive. Furthermore, a safety-related critical application of high-concentrated bundled beams is avoided by the spread production of high-energy radiation within the bending die. Thus, when using such a bending die, the safety precautions necessary for the operator within the surroundings of such a bending die tend to be less complex.

The application of diode laser bars as radiation sources is especially advantageous for local heating of sheet metal workpieces, because in this case there are energy densities that can effect a sufficiently quick heating, but a destruction of the workpiece due to a too long exposure duration is hardly possible or severe injuries of an operator in case of unexpected emission of radiation are less possible due to the limited energy density. The radiant exposure of a workpiece and the thereby caused local increasing of temperature lasts at least as long as the material of the workpiece has achieved the formability necessary for the bending process. Particularly, the laser radiation can be maintained until the beginning of the bending process or even until the finishing of the bending process to especially avoid fractures that can probably appear due to high degrees of deformation and/or to achieve the effect of a local heat treatment of the deformed material, as for example to reduce tensions.

According to another embodiment of the bending die, diode laser bars are mounted on a carrier element and thus a connected diode laser insert is embodied, which is exchangeable fixed in the tool base body. Thus, in case of a defect, the entire diode laser insert can be exchanged easily and quickly and downtimes in production can thus be minimized. Furthermore, thus the expenses for spares inventory can be reduced and defective diode laser inserts can probably be also repaired independently from the application of the bending die by exchanging single diode laser bars. In addition, the diode laser inserts can also be mounted into bending dies or tool base body with different die widths, so that in case of retrofitting to another die width the costs for the purchase of expensive additional diode laser inserts are omitted.

Alternatively, other die widths can also be realized by pluggable or exchangeable inserts or adaptors that can be attached easily removable to the top face of the bending die.

The carrier element is preferably made of plastics, especially of PEEK-plastics, thereby allowing that the single diode laser bars can be mounted independently in a galvanical way from each other to form a unit.

The diode laser bars of a bending die or a diode laser insert are advantageously connected with each other electrically in series, what ensures that each diode laser bar is flown through by the same current and emits the same radiation performance. Furthermore, due to the serial connection, the malfunction of single diode laser bars can be recognized easier because in this case none of the diode laser bars emits radiation performance what can easier be recognized than the case when only one diode laser bar does not emit radiant power and only parts of the deformation zone are not heated sufficiently.

In case of a serial connection of the diode laser bars, the power connection between two adjacent diode laser bars can preferably be embodied from a positive terminal of one diode laser bar to a negative terminal of the other diode laser bar by a diagonal connection element, especially of a Cu-alloy. Such diagonal connection elements have a large electrical conductive cross section, with the result that only slight losses of current appear there and due to their high mechanical stability, said diagonal connection elements can also contribute to the mechanical stability of the diode laser insert or the bending die according to the present invention. Because the laser diodes arrangements of the diode laser bars are mounted on cooling elements or microchannel coolers, they can be used as electrical terminals and the contact elements can disable a laser diodes arrangement by one contact element touching two adjacent microchannel coolers and thus producing a direct flow of current past the laser diodes arrangement.

An advantageous development of the bending die is that there are switchable contact elements within the bending die, especially at the diode laser insert, which can be used to disable single diode laser bars from several serial connected diode laser bars by direct bypassing between the corresponding equal terminals of adjacent diode laser bars. Due to such contact elements, single diode laser bars can quasi be bypassed and thus the radiation emitted through the beam exit opening of the bending die can be adjusted to the entirety of the diode laser bars, especially to the bending length of the workpiece to be bent by bypassing and thus disabling diode laser bars the radiation of which would not hit the workpiece.

In this case, the contact elements can especially be adjustable between a neutral position and a bypassing position by means of piezo actuators. Such piezo actuators are easily obtainable in various designs and can be mounted within a bending die for operating the contact elements requiring very little space. For an axial adjustment of pencil-shaped contact elements in direction of the longitudinal axis, it is advantageously possible to use piezo actuators that, with their free, movable ending, radially mesh with the contact elements and a bending movement of the moveable ending causes an axial adjustment of the contact element.

A simple and effective arrangement of the contact elements is achieved when the latter are such positioned and adjustable mounted relating adjacent diode laser bars, that they are applicable for establishing an electrical connection between corresponding terminals of adjacent diode laser bars or between adjacent diagonal connection elements. Due to this arrangement of the contact elements, quasi a short circuit between the terminals of adjacent diode laser bars is established and thus a diode laser bar is disabled.

The contact elements can furthermore such be mounted moveable within the bending die that an initial position caused by a spring element causes an electrical bypassing between two adjacent diode laser bars, which is interrupted only due to the activating the piezo actuators, that means without the enabling the piezo actuators, the corresponding diode laser bar remains disabled and does not emit laser radiation. This mounting of the contact elements also serves for the enhancement of the safety at work, because in case of a defect at one of the piezo actuators laser radiation is emitted in an unrequired kind. Alternatively it can be provided, that in case of a defective piezo actuator the diode laser insert is usable as a usual diode laser insert without partial disabling. In this case, the bypass of the initial position of a contact element should be open, so that the diode laser bars are not bypassed.

To avoid or compensate an eventually appearing beam widening of the laser radiation emitting from the diode laser bar, a beam forming element, especially a cylindrical lens with an axis of curvature parallel to the longitudinal axis of the strip-shaped beam exit area, can be arranged at or in the beam path behind the beam exit area of the diode laser bar. Said beam forming element reduces a beam widening transverse to the propagation plane of the beams or the planar fanned beam that means a so-called Fast-Axis-Collimation is effected. A beam widening within the beam propagation plane of the plane of the diode laser bars is mostly harmless because it generally does not unfavorably affect the distribution along the bending recess. In order to reduce or avoid beam widening cylindrical lens elements for achieving a Slow-Axis-Collimation can be provided, which can be used to reduce a beam widening within the beam propagation plane as well. The axis of curvature of the cylindrical lenses for the Slow-Axis-Collimation stands thereby vertically on the beam propagation plane of the planar fanned beams.

An advantageous embodiment of the bending die is that the tool base body is provided with an air connection and an adjacent air duct or flow path, which can be used to lead scavenging air into the region of the bending recess under the workpiece or between the diode laser bar and the workpiece and that said scavenging air exits at another place. Thus, the parts bordering the air duct are cooled and furthermore, a deposit of dust or other contaminations in the beam guiding channels or at the optical elements within the bending die can be reduced.

Due to the reason that in case of heating a workpiece heat always drains into cooler areas that are not exposed to the radiation and thus into the bending die, it is advantageous if the contact surface of the bending die is made of a material with a lower coefficient of heat-conductivity than the tool base body. For this purpose, the contact surface can for example be embodied of strip-shaped PEEK-plastics elements or other heat insulating materials that are fixed to the top face of the tool base body. The lay-on points, effective after the beginning of the deformation process, of the bending recess at the bending die, can be built by the tool base body itself for stability reasons. Furthermore, the tool base body itself can be made of a metal with a heat conductivity $\lambda$ smaller than common steel with approximately 45 W/Km.

The material of the tool base body can alternatively or additionally have a coefficient of thermal expansion a smaller than common steel (approx. 0.00002 1/K), with the result that geometrical deformations, due to heating, of the bending die are reduced.

In order to keep necessary measures for the distribution of the radiant power along the bending recess as low as possible, preferably the diode laser bars are arranged parallel to the elongate bending recesses with their effective beam exit areas, with the result that the beams emitted by the single diode laser bars directly or after passing a beam affecting arrangement essentially extend in a shared beam plane out of the beam exit opening towards the bending line at the bottom side of the workpiece. As a variant thereto, also another orientation of the diode laser bars is imaginable, as there is for example an imbricate overlapping of the beam exit areas, seen in plan view.

As a tool for the even distribution of the radiation emitting from the diode laser bars, radiation can be deflected by means of beam control means, particularly in form of prisms, whereby the deflection of the beams without modifying the plane of the beam expansion is possible but can also effect a modification of the beam propagation plane, in a sense of kinking it.

An advantageous constructional embodiment of the bending die is achieved if the tool base body comprises at least two laminar tool sections being parallel to and spaced apart from each other and between which the diode laser bars and the probably existing adjacent optical components are positioned. The radiation source and the means for affecting the laser radiation are thus extensively embedded in the inner of the tool base body and the beams extend within the tool base body to the exit of the beam exit opening, what extensively avoids uncontrolled exit of beams, which can possibly endanger an operator. Due to the laminar tool sections, the tool base body has a U-shaped cross section, with the diode laser bars and possible existing adjacent optical components being arranged inside the U and the workpiece to be bent rests on the limbs of the U.

The mechanical stability of the bending die according to the invention can be substantially increased, particularly in case of the U-shaped cross section of the tool base body, if at least one spacer element and at least one clamping element clamping the tool base body against the spacer element are mounted between the diode laser bars and the beam exit opening. So, a widening of the bending die by the bending punch can be countervailed and this can be effected the better, the closer the spacer element or the spacer elements are positioned to the contact surface. Furthermore, these spacer elements cause an additional security from a penetration of the bending punch into the inner of the bending die, with the result that this and especially the diode laser bars could be destroyed. The spacer elements can also be produced of glass that is transparent related to the wavelength and can be positioned within the beam path, so that another beam forming is possible by means of a purposeful shaping of the spacer elements. In this case they could especially be cylindrical diverging lenses. The clamping elements can also be embodied as simple positive connection or locking elements that enable a plugging together of the two halves of the tool.

In case of an embodiment of the bending die with non-transparent spacer elements, for example spacer elements of metal, it is advantageous if the laser radiation is guided at least nearly completely past the spacer element or the spacer elements to the beam exit opening by means of beam control means. Thus, as little radiation energy as possible is absorbed by the spacer elements and the biggest part possible of the radiation energy is made available for the heating of the workpiece.

Due to the fact that depending on the material of the workpiece to be bent and its surface condition a certain part of the laser radiation is reflected, it is furthermore of advantage if the area of the spacer element facing the beam exit opening is embodied reflective, with the result that the radiation reflected by the workpiece and hitting said reflective area would be reflected back to the workpiece. Thus, also with surfaces of workpieces having a high level of reflection, a high part of the laser radiation can be used for the local warming of the deformation zone.

To avoid best an entering of dust or other contaminations through the beam exit opening, it can be closed by at least one radiolucent covering element. This can, due to its partly reflective surface, also contribute to reflect the laser radiation reflected by the workpiece back to the workpiece. Furthermore, the covering element can comprise a dispersing lens, can be additionally arranged to one or embodied by one, with the result that another fanning out of the laser beams can be effected and the radiant power along the deformation zone or the bending line can be spread more evenly. The dispersing lens can probably, as explained above, have also the function of a spacer at the same time.

Because not every workpiece covers the entire bending recess, because its bending length, that means its dimensions regarding the deformation zone or along the bending line, is shorter than the length of the bending die and an emission of high-energy radiation next to the workpiece should be avoided due to job security reasons, in case of an advantageous embodiment of the bending die at least one adjustable shielding element for covering sections not being covered by the workpiece are provided between the beam exit opening and the contact surface. Said shielding element can be embodied as a slider adjustable along the bending recess and, depending on the bending length of the workpiece, the part of the bending recess that is not covered by the workpiece, is thus covered by the shielding element and thus at least a direct emission of radiation next to the workpiece can be avoided.

In order to be able to control the local heating of the workpiece better, it is of advantage if the power emitted by radiation source is and/or the necessary exposure duration of the radiation to the metal and/or the geometric dimensions of the workpiece to be bent are adjustable by means of a control device. The control device used therefor can be realized by the control device of the bending press, the control device of the radiation source or as an own control device. Particularly, the exposure duration can also be set or controlled with the help of a temperature measuring within the deformation zone. In this case, during the radiation of a workpiece, its temperature within the deformation zone is continuously measured either contactless or tactile with a temperature sensor and a control device, depending on the temperature measured and the preset temperature initiates, accelerates or decerlates a bending process or the control device increases, reduces or deactivates the laser radiation by enabling or disabling single or several diode laser bars. With the help of such a temperature measuring, the heating—and/or the deformation phase can thus be best adjusted to the material-specific requirements and such a bending process with application of the bending dies according to the invention is especially advantageous. The distribution of the temperature along the bending line can be recorded and, if applicable, corrected by measuring of the temperature at different positions. As measurement methods for contactless measuring of temperature especially infrared thermometer, radiation pyrometer or thermographic cameras are used. As tactile temperature sensors, especially thermal elements integrated in the bending punch or the bending die make sense.

In order to be able to employ a bending die according to the invention at most possible bending presses or press brakes, it is advantageous if the tool base body at its end section facing away from bending recess features a connection profile that can be accommodated in a standard tool holder. In this case, said connection profile can have additional recesses or grooves, which can probably cooperate with locking elements of the tool holder.

In order to make a bending die according to the invention ready for operation as fast as possible and with little assembly effort it is advantageous if the tool base body or the diode laser insert has interfaces for connecting and/or transferring cooling air or coolant and/or operating current and/or control current. These interfaces can particularly be embodied as plug connections being arranged at the front sides of the tool base body or a diode laser bar of the bending die and thus, by arranging banding dies one after another, connections between adjacent bending dies are effected automatically. For the connection of channels for coolant, appropriate openings at the front sides of adjacent bending dies can be pressed together, whereby a close connection can be ensured by O-ring-seals arranged outside of the openings.

A bending die according to the invention can be such embodied that the tool base body comprises die adaptor creating the contact surface and the bending recess, with the die adaptor being exchangeable arranged at the remaining part of the tool base body which contains the diode laser bars. By exchanging the die adaptor the tool base body can thus be adjusted to different bending tasks. It is particularly possible to change the die width, which causes the range of application of such a bending die to be substantially larger. Furthermore, such a bending die being relatively expensive due to the inserted diode laser bars, can be applied more frequently and thus more cost-effectively.

In order to deform also workpieces exceeding the length of the bending die, it is possible to connect a number of bending dies according to the invention directly adjacent to form a die arrangement. Embodiments of bending dies or diode laser inserts with plug connections for coolant and/or operating current and/or control current at the front sides are particularly applicable for that purpose, because in this case the connection to a functioning die arrangement can be effected very easy and fast.

In case of such a die arrangement, adjacent and aligned bending dies can be axially clamped against each other by means of at least one axially effective clamping element, with the result that the stability of such a die arrangement is increased and furthermore a beam emission in the region of the front walls is reduced or avoided.

A part of the invention is also a method for bending a flat workpiece with local heating of the workpiece in the region of a bending line by means of a laser radiation emitting out of a bending die, with the heating being effected by means of a bending die according to the invention or a die arrangement according to the invention and during the heating by means of laser radiation the temperature of the workpiece being measured at the bending line and the temperature being guided to an electronic control device as a measurement. Depending on the temperature measured, said control device initiates, accelerates or decelerates a bending process and/or the laser radiation is increased, reduced or enabled by enabling or disabling single or several diode laser bars.

The method can advantageously be such embodied that the workpiece, before the application of radiation by the bending punch, is subject to a slight, particularly elastic bending deformation and fixed in that position by the bending punch. In the following, the heating by discharging of radiation to the bottom side of the workpiece is effected and after expiring a predefined period of time from activating the radiation, which can also equal naught, or starting at the point of time when the deformation zone of the workpiece has reached a certain temperature, the bending deformation is continued with the radiation remaining activated until the bending deforming is finished or nearly finished. Thus, at first the workpiece is clamped, so to say, for fixation and stiffening of the workpiece against unexpected deformation due to heat stress. The firstly time-shifted, in case of continued or interrupted punch movement following activation of the laser radiation with the thus effected heating of the deformation zone of the workpiece increases, the plastic deformability of the actual brittle and the bending process can also be continued up to the area of high deformation degrees without resulting in cracks or breaks in the material. Thus, the punch movement can be performed without interruption but also with an interruption, within of which a certain level of temperature of the deformation zone is reached. A monitoring of the temperature can also ensure that the laser radiation is enabled and effective, with the result that undesired cold working can be avoided in an elegant way.

For a better understanding the invention will be described in more detail by means of the following figures.

In a highly schematically simplified way:

Figure 2:
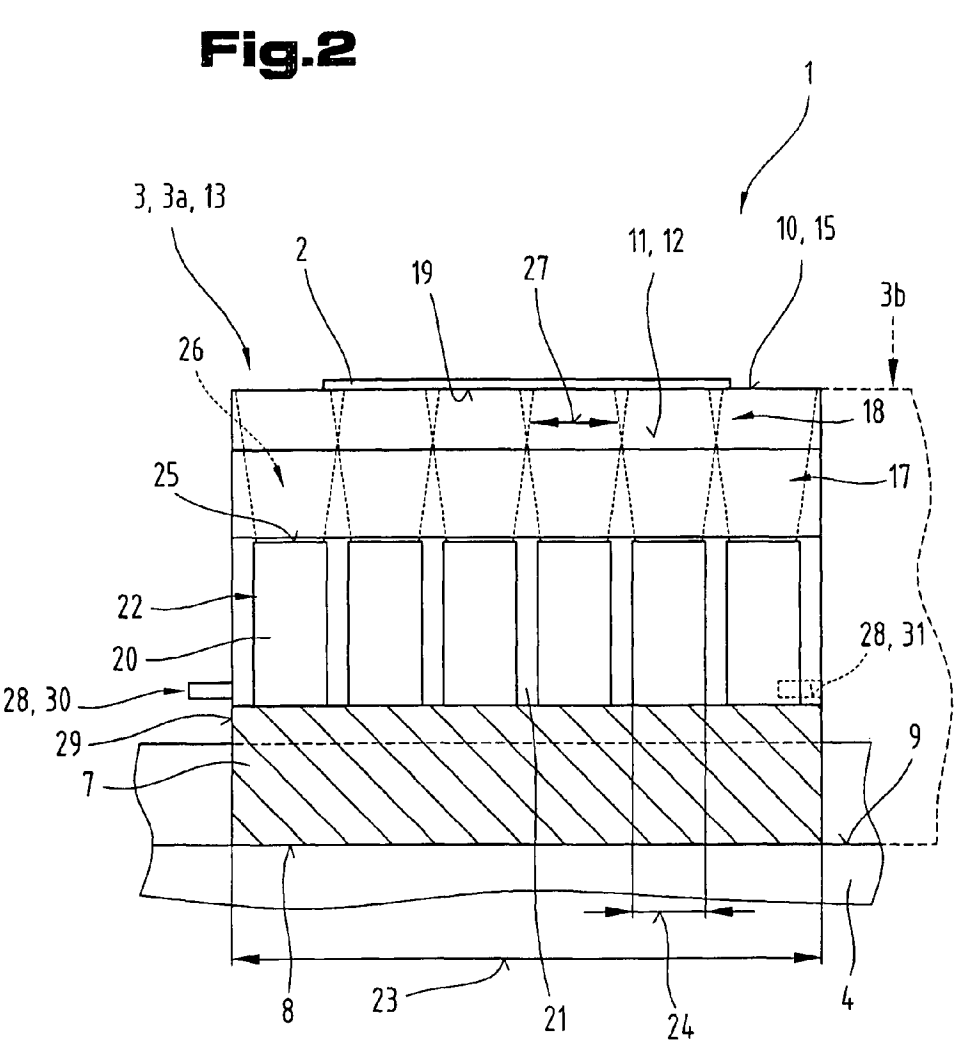
FIG. 2 shows a section view through the bending die in FIG. 1 along the line II-II with schematically displayed distributed generation of high-energy laser radiation within the bending die.

First of all, it should be pointed out that in the variously described exemplary embodiments the same parts are given the same reference numerals and the same component names, whereby the disclosures contained throughout the entire description can be applied to the same parts with the same reference numerals and the same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described may be construed as independent inventive solutions or solutions proposed by the invention in their own right.

All details relating to ranges of values in objective description are to be understood in a way that any and all partial ranges therein are also included, for example the specification 1 to 10 is to be understood in a way that all partial ranges starting at the lower threshold 1 and the upper threshold 10 are included within, that means that any partial ranges start at a lower threshold of 1 or larger and end at an upper threshold of 10 or less, for example 1 to 1.7 or 3.2 to 8.1 or 5.5 to 10.

Figure 1:
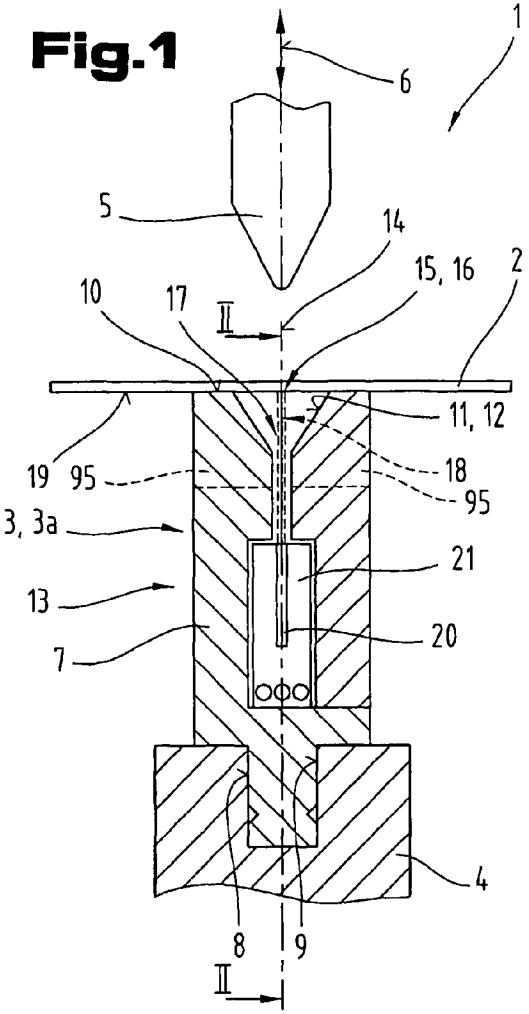
FIG. 1 shows a cross-section through a bending tool arrangement for deforming a workpiece comprising a bending die according to the invention and a bending punch.

In the FIGS. 1 and 2, a bending tool arrangement 1 is displayed, that is applicable for bending a workpiece 2 using one or several bending dies 3 according to the invention. The bending tool arrangement 1 comprises at least one bending die 3 arranged at a stationary first press beam 4, adumbrated in sections, of a bending press or a trimming press and a bending punch 5 that is adumbrated in FIG. 1 and that is arranged at a not displayed displaceable second press beam and that is bedded displaceable in the direction of adjustment 6 for performing a bending deformation together with not displayed displaceable second press beam. The bending die 3 comprises a tool base body 7 that essentially equals a common bending die regarding its outer dimensions. Thus, the bending die 3 preferably comprises a connection profile 8 that is applicable for being held in a standard tool holder 9 of a press beam 4.

For bending the workpiece 2, it is contacted to a contact surface 10 of the bending die 3 and pressed into a groove-like bending recess 11 within the contact surface 10 by means of a bending punch 5, with the result that the workpiece 2, when tensions exceeding the elastic limit or a stress-strain limit appear, receives an enduring deformation. In the exemplary embodiment shown in FIG. 1, the bending recess 11 is embodied as a V-shaped groove 12 and the bending die 3 is thus embodied as a V-shaped die 13. Nevertheless, different forms of the bending recess are also possible, as long as they are applicable to allow the so-called air bending that means the bending by resting the workpiece at two lines of the bending die 3 and the approximately line-shaped strain by the bending punch 5. Thus, also U-shaped or rectangular bending recesses are thinkable. The bending punch 5 has a tapered cross-section, the wedge-angle of which approximately equals the angle of the V-shaped groove 12 and is arranged at least approximately in the plane of symmetry of the bending recess 11. The bending method performable with such a bending tool arrangement 1 is also called folding and can be performed as air bending or coining.

In another description, the vertical plane of symmetry of the bending recess 11 in FIG. 1 is described as bending plane 14 and its intersection point with the contact surface 10 is described as bending line 15, with the bending plane 14 coinciding with the beam plane, in which the high-energy radiation mainly extends. The bending line 15 thus extends in the middle of a deformation zone 16 of the undeformed workpiece 2, where the plastic deformation of the workpiece 2 is performed during the bending process.

Generically, in case of the method according to the invention, before or during the deformation a high-energy radiation 18 partly marked by a dashed line is, in the area of the deformation zone 16, led through a beam exit opening 17 to the bottom side 19 of the workpiece 2 bearing against the contact surface 10, with the result that the workpiece 2 is locally heated and thus its mechanical-technological characteristics are changed in a way that the bending deformation can be effected with the necessary quality of the finished workpiece 2. The method according to the invention is preferably applied to brittle raw material, the tension elastic limit or a stress-strain limit of the material of which can be reduced by heating the material and the workpiece 2 can thus bear the tensions necessary for the deformation—now in lower degree—without exceeding the breaking points. As examples for such raw materials, magnesium, titanium, spring steel, high-strength aluminum-alloys, high-strength steels or other materials known as brittle can be named here.

According to the invention, the high-energy radiation 18 is produced by laser radiation from several diode laser bars 20 that are arranged within a bending die 3.

In the exemplary embodiment shown in FIG. 2, six diodes are arranged within the bending die 3 that are secured to a common carrier element 21 and that are, together with the carrier element 21, part of a diode laser insert 22 that is preferably secured in an exchangeable way as laser unit in the tool base body 7. Of course, also other numbers of diode laser bars 20 can be included by a bending die 3 according to the invention, and the respective number of diode laser bars 20 contained by the bending die 3 and their dimensions are determined by the die length 23. Because the bar width 24 of the used diode laser bars 20 are not obtainable in any size and bar widths between 5 mm and 20 mm and numbers of bars between 2 and 16 or 16 and 32 pieces are possible, die lengths in a wide possible range between approximately 10 mm and 400 mm or 640 mm result.

Such diode laser bars 20 are electrically and optically combined groups of laser diodes that are embodied to be strip-shaped components. The laser diodes emitting laser radiation are arranged at the one end of such a strip-shaped diode laser bar and substantially emit their laser radiation in longitudinal direction of such a strip. The radiant power of such a diode laser bar 20 is made up of the sum of the single power of the laser diodes that are electrically parallel and generally mounted to a cooling element or a heat sink making up the base body of the strip-shaped component. Such diode laser bars 20 are also referred to as edge-emitting broad area diode laser and can be used either with the mode of operation continuous wave, where the laser diode continuously and without interruption emits a laser beam or the mode of operation pulsed, where timely short laser beam impulses are emitted. The diode laser bars 20 for example comprise approximately 45 single emitters each and have an optical output power in a range of 150 Watt to 250 Watt each and also even higher performances per diode laser bar 20 are possible due to special construction forms. The bar width 24 or the width of a cooling element or the microchannel cooler creating the base body of a diode laser bar is for example 11 mm and the laser bar emitting the laser radiation has a width of for example 10 mm with the emitting effective width being slightly smaller. Thus, when using such diode laser bars 20 in case of short distances between the adjacent diode laser bars 20, eight suchlike diode laser bars 20 can be inserted into a bending die with a die length 23 of for example 100 mm. The wave length of the emitted laser radiation depends on the kind of the inserted diode laser bars 20, whereby the laser radiation is for example 940 nanometers, but depending on the doping of the semiconductor of the laser diode also other ranges of wave lengths are possible, as there are 635 to 700 nanometers; 780 to 1000 nanometers and 1250 to 1700 nanometers, whereby in this case mainly infrared radiation, that means areas beyond the visible spectrum are concerned.

Each diode laser bar 20 has a beam exit area 25 pointing towards the beam exit opening 17. At said beam exit area 25 all laser beams produced by the single laser diodes of a diode laser bar 20 exit generally approximately in parallel direction and build a planar fanned beam 26 due to the even arrangement of the laser diodes. Said planar fanned beam consists of a row of laser beams extending at least approximately parallel to each other. Because the single diode laser bars 20 are mounted along the bending recess 11 behind the beam exit opening 17, in this case thus below the beam exit opening 17 in a common plane, also the planar fanned beams 26 emitted by the single diode laser bars 20 are located at least approximately in one plane that can also be referred to as beam plane. In the displayed exemplary embodiment, this plane is substantially identical with the bending plane 14, but can also take an angle to it as long as sufficient radiant power can be applied in the area of the bending line 15 or the deformation zone 16 at the workpiece during the deformation process. Thus, the beam plane can for example be slightly tilted back so that possible emitting radiation hits the upper tool at the rear side and the radiation thus produced is reflected into the bending press away from the operator. Thus, the radiation hits the undeformed workpiece slightly offset behind the bending line what is no serious disadvantage due to the good thermal conduction of most of the raw materials to be bent.

A sequence of several laser diode laser bars 20 with planar fanned beams 26 being in one plane and approximately parallel to each other to be a diode laser insert 22, particularly with means for removal of thermal losses, is also called horizontal stack.

Because the laser beams emitted by the laser diodes do not have the form of a geometrically correct line (z-direction) but, due to the generally asymmetric form of the active emitter region, can have different beam widening in both the x-direction and in the y-direction, and additionally, the output beam can be astigmatic, with the result that the beam waists regarding the x-direction and the y-direction are located at different positions, an inevitable beam widening is produced, which can be counteracted by measures that will be described later. For lower requirements to the beam form it is nevertheless thinkable to use diode laser bars 20 without beam affecting or correcting, optical elements.

In FIG. 2, this widening of the single beams by planar fanned beams 26 widening in direction of propagation is adumbrated, whereby a beam widening within a beam plane can be advantageous for the purposes of the heating of a workpiece, because the evenness of the intensity of the total radiation hitting the workpiece can be increased due to applicable overlapping of such planar fanned beams 26. Furthermore, the usage of diverging laser beams or planar fanned beams 26 is also advantageous with respect to the job safety because laser radiation emitting from the surrounding of the bending die 3 quickly loses intensity according to increasing distance and thus the potential risk of danger for an operator working in this area also quickly decreases. The two latter reasons, that means the more even heating and the increased safety for operators argue for additional diverging lenses or optics.

A distribution achieved by the beam forming and beam guiding have a defusing effect, so to speak, and is of special advantage if workpieces with different bending lengths are to be bent with one bending die 3, because in this case, there are frequently sections of the bending recess 11 that are not covered by the workpiece 2.

The widening of the planar fanned beams 26 within the beam plane, here the bending plane 14, adumbrated in FIG. 2, also serves for the evenness of the intensity of the total radiation at the workpiece 2, because in the interspaces between two adjacent beam exit areas 25 of adjacent diode laser bars 20 no radiant power is emitted and thus, in case of strict parallel distribution of the beams, areas of the deformation zone 16 above said interspaces are probably less heated what can have an negative affect on the bending quality. In order to achieve the largest possible power density per unit of length and thus to minimize the necessary heating-up periods, it is furthermore of advantage if the beam exit area 25 of the diode laser bars 20 extends at least approximately over the entire bar width 24 and if the smallest possible interspaces are provided between adjacent diode laser bars 20. The diode laser bars 20 thus follow as closely as possible behind the beam radiation exit 17 in longitudinal direction 27 of the bending recess 11 and they are arranged as evenly as possible.

FIG. 2 furthermore shows a connection interface 28 which is used to supply the diode laser insert 22 with current for the diode laser bars 20 as well as coolant for cooling elements or heat sinks, for example in form of microchannel cooler, inside diode laser bars 20. The connection interfaces 28 can thereby by provided at any position at the lateral front sides or the front or rear sides of the bending die 3. An arrangement at or close to the end face area 29 of the bending die 3—either at the tool base body 7 or at a diode laser insert—is nevertheless advantageous, because in this case adjacent bending dies 3*a* and 3*b* can be connected with each other by means of connection interfaces 28 facing towards and cooperating with each other, with the result that either the supply current and/or coolant can be led from one bending die 3 to an adjacent bending die 3. Alternatively, a transmission of current and/or coolant between adjacent bending dies 3 is also possible by means of applicable, external connecting lines, whereby the clearance for the insertion of the workpiece necessary for the execution of bending should not be reduced.

The connection interfaces 28 can especially comprise plug connections 30 with the help of which adjacent bending dies 3*a* and 3*b* can automatically produce the connections necessary for the transmission of current and/or coolant by axial assembly. Cooperating connection interfaces 28 additionally comprise cooperating plug connections 30 pointing towards the end face area 29 as well as an according insertion opening 31 at the other bending die 3. Especially when using the connection interfaces 28 for transmission of coolant between adjacent bending dies 3*a* and 3*b*, the used plug connections 30 or the insertion openings 31 or the end face areas 29 around simple corresponding openings are equipped with corresponding O-ring sealings to avoid an uncontrolled discharge of coolant at the seams of the bending dies 3*a* and 3*b*.

Figure 3:
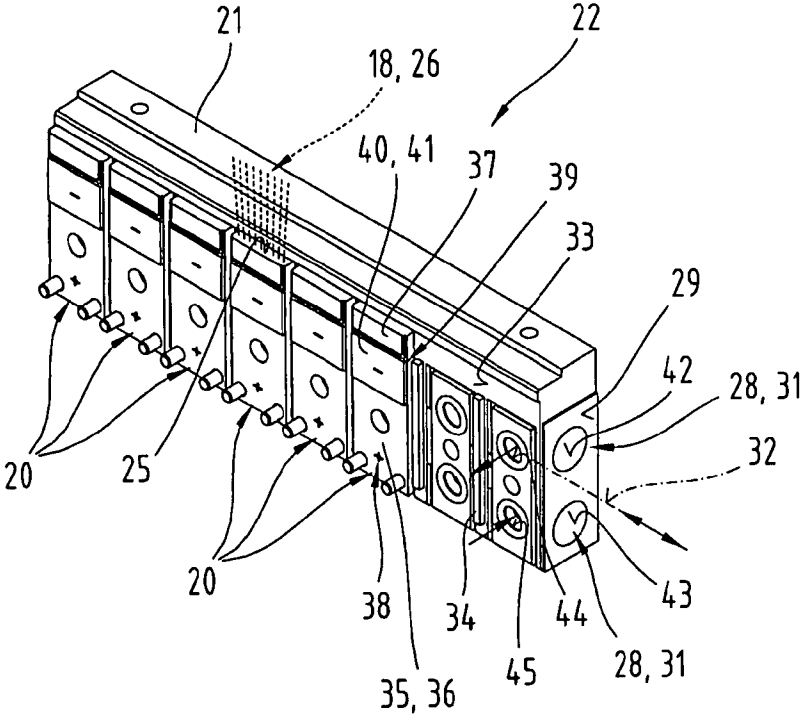
FIG. 3 shows a view of a partly assembled diode laser insert with several diode laser bars with cooling elements in form of microchannel coolers, applicable for the use in a bending die according to FIG. 1 or FIG. 2.

FIG. 3 shows a carrier element 21 populated with six of eight diode laser bars 20 provided. Said carrier element 21 can be comprised by a diode laser insert 22 according to FIGS. 1 and 2. The carrier element 21 is essentially a block-shaped base body, the longitudinal axis 32 of which extends parallel to the bending line 15 or the longitudinal direction 27 of the bending 11 and on which at least two—in the displayed exemplary embodiment eight—diode laser bars 20 are arranged. The single diode laser bars 20 are secured on a fixing surface 33, in mounted state according to FIG. 1 being positioned with small distance and parallel to the bending plane 14. Bars 34 facilitating the exact positioning of the diode laser bars 20 with even distances essentially matching the width of the bars 34 can be embodied at the fixing surface 33. At the two outer right positions in FIG. 3, no diode laser bars 20 are shown, with the result that the embodiment of the carrier element 21 is better to recognize.

A diode laser bar 20 shown in this exemplary embodiment comprises a as base body a strip-shaped cooling element 35, which is particularly embodied as a microchannel cooler 36. Such a microchannel cooler 36 consists of an arrangement of layers of good heat conducting metal sheets in which a number of channels that can be flown through by a coolant and thus allow a high heat release out of the diode laser bars 20, are embodied. This is necessary because the laser diodes arrangement 37 arranged on the cooling element 35 or the microchannel cooler 36 cannot completely transform the electrical energy fed into high-energy radiation 18 but always produces a certain share of thermal losses that have to be removed away from the laser diodes arrangement 37 to avoid an overheating of the semiconductor elements contained therein. The feeding of electrical energy to a diode laser bar 20 or the laser diodes arrangement 37 arranged thereon is effected in form of direct current or pulsing rectified alternating current. In the exemplary embodiment, the cooling element 35 acts as a positive terminal 38 and the negative terminal 40 is separated from it by means of an insulation bed 39 and embodied in form of a contact plate 41 put on the cooling element 35.

To simplify matters, only one planar fanned beam 26, extending from the diode laser bar 20 upwards in the direction of the beam exit opening 17 and in succession farther to the workpiece 2, is adumbrated in FIG. 3. Due to the sequencing of a number of such planar fanned beams 26, the line-shaped heating of the workpiece 2 in the area of the deformation zone 16, as already described on the basis of FIG. 2.

In the exemplary embodiment, the coolant for heat removal from the diode laser bars 20 is fed to and removed from the cooling element 35 through the carrier element 21. For this purpose, a supply channel for coolant 42 being parallel to the longitudinal axis 32 and an outlet channel for coolant 43 being parallel thereto are embodied in the carrier element 21, with the higher pressure of coolant being within the supply channel for coolant 42. At every diode laser bar 20, a connecting bore 44 diverges from the supply channel for coolant 42, with said connecting bore 44 extending to the fixing surface 33 and the thereto respective adjacent cooling element 35 of a diode laser bar 20. After having flown through the cooling element 45 and absorbing the thermal losses released by the laser diodes arrangement 37, the coolant flows through another connecting bore 45 to the outlet channel for coolant 43, which is used to discharge the coolant out of the diode laser insert 22 and thus also out of the bending die 3. In case of the exemplary embodiment shown, a so-called microchannel cooler 36 representing an example for an active cooling element is used as a cooling element 35. Nevertheless, it is also possible to effect the removal of the thermal losses of the laser diodes arrangement 37 by means of other cooling elements, for example passive cooling elements.

The carrier element 21 can be made of several raw materials, for example metal, preferably stainless steel, that is characterized by a good heat conduction and further supports the removal of the thermal losses. Due to the fact that the cooling elements 35, nevertheless, can act as electric pole of the diode laser bars 20, as described above, it is necessary to provide the carrier element 21 made of metal with a insulation bed between the diode laser bars 20 and the fixing surface 33 at the carrier element 21. It is also especially advantageous if the carrier element 21 is made of PEEK-plastics (polyether ether ketone). These plastics have excellent chemical resistance properties and do thus not limit the range of applicable coolants. Furthermore, PEEK-plastics are very heat-resistant with melting temperatures of more than 300° C. and they bear temperatures of more than 200° C. when being used. Furthermore, PEEK-plastics have electrically isolating properties, with the result that adjacent diode laser bars 20 are galvanically separated without any additional isolating materials.

In the simplest case, usual water can be used as a coolant, but preferably distilled or deionized water is used, which is characterized by a high heat capacity and thus a good heat removal.

Figure 4:
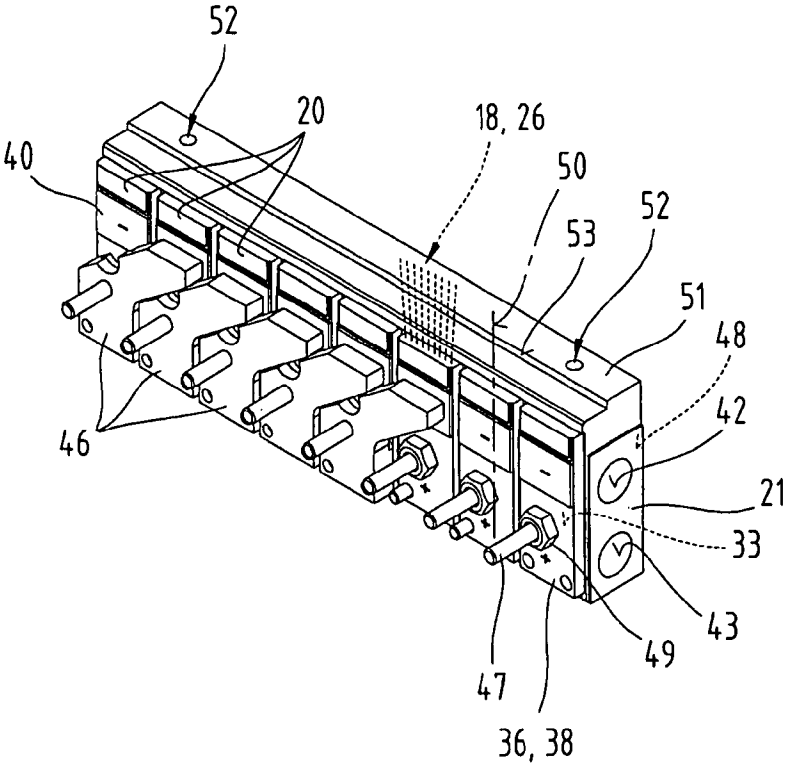
FIG. 4 shows a partly assembled diode laser insert according to embodiment in FIG. 3 with partly mounted elements for current carrying.

FIG. 4 shows the carrier element 21 described in FIG. 3 with thereto secured diode laser bars 20, which are, according to the exemplary embodiment according to FIG. 4, electrically connected in series by means of diagonal connection elements 46. In this case, a diagonal connection element 46 connects a positive terminal 38 of a diode laser bar 20 with the respective negative terminal 40 of an adjacent diode laser bar 20. By means of voltage application between the negative terminal 40 of the most left diode laser bar 20 and the positive terminal 38 of the most right diode laser bar 20, the same current flows through each of the diode laser bars 20 connected in series and their radiatively active laser diodes arrangements 37, with the result that it is ensured that all diode laser bars can emit the same radiation energy. Alternatively, also a parallel connection of the diode laser bars 20 would be thinkable, whereby for achieving the same high radiation energy at all diode laser bars 20, these would have to be connected parallel to very small electrical resistors by means of contact elements to provide all diode laser bars with at least approximately the same supply voltage.

The mechanical fixing of the diode laser bars 20 is for example effected by fixing screws 47 that project through the carrier element 21 from its rear side 48 into the direction of the fixing surface 33 and a diode laser bar 20 is clamped against the fixing surface 33 of the carrier element 21 by means of a female screw 49 or comparable fixing elements. The section of the fixing screw 47 protruding the female screw 49 can furthermore, as shown in FIG. 4, be used for positioning and fixing the diagonal connection elements 46 by projecting them through the through holes and consequently being pressed against the contact surface 10 to a positive terminal 38 of a first diode laser bar 20 and a negative terminal 40 of an adjacent second diode laser bar 20. In the exemplary embodiment shown, the diagonal connection elements 46 have cranked shape, with the lower third, which is in contact with the positive terminal of a diode laser bar 20, being approximately aligned parallel to the longitudinal axis 50 of the diode laser bars 20 and the remaining part of the diagonal connection elements 46 being oriented diagonally towards the negative terminal 40 of an adjacent diode laser bar 20. Notwithstanding this, also other embodiments of diagonal connection elements are possible, too. In case of an embodiment of a bending die 3 with eight diode laser bars 20, seven diagonal connection elements 46 are thus necessary to create the serial connection.

In case, only one bending die 3 is used for bending the workpiece 2, the negative terminal 40, in FIG. 4 unengaged at the left diode laser bar 20, and the positive terminal 38, unengaged at the right diode laser bar 20, are connected to a d.c. source, which is for example made of a power supply unit connected with a rectifier by means of appropriate line segments that can also be made of housing parts of the diode laser insert 22. The power supply of such a diode laser insert 22 can of course also be effected by means of an electronic control device, that is for example also used for controlling a bending press used for the bending process, but also by means of an own control device being connected to a bending press via interfaces.

FIG. 4 further shows a retaining ledge 51, which, in direction of beam distribution, follows the carrier element 21, is formed directly on the carrier element 21 or is separate. Said retaining ledge 51 which is for example connected to the carrier element 21 by a screw connection 51 and features a retaining groove 53, which can be used to position and hold optical relevant components for deforming and deflecting the radiation or the planar fanned beams emitted by the diode laser bars 20 relative the diode laser bars 20. In this way, prisms and lenses can be hold, which can be used to modify the planar fanned beams 26 temporarily by means of a retaining groove 53 and another retaining groove, not shown in FIG. 4, at the opposite housing part of the diode laser insert 22, closing the visible front side in FIG. 4. Substantially focusing or diverging lens systems as well as beam deflecting prisms are used as optical components, what will be described on the basis of other exemplary embodiments or figures.

Figure 5:
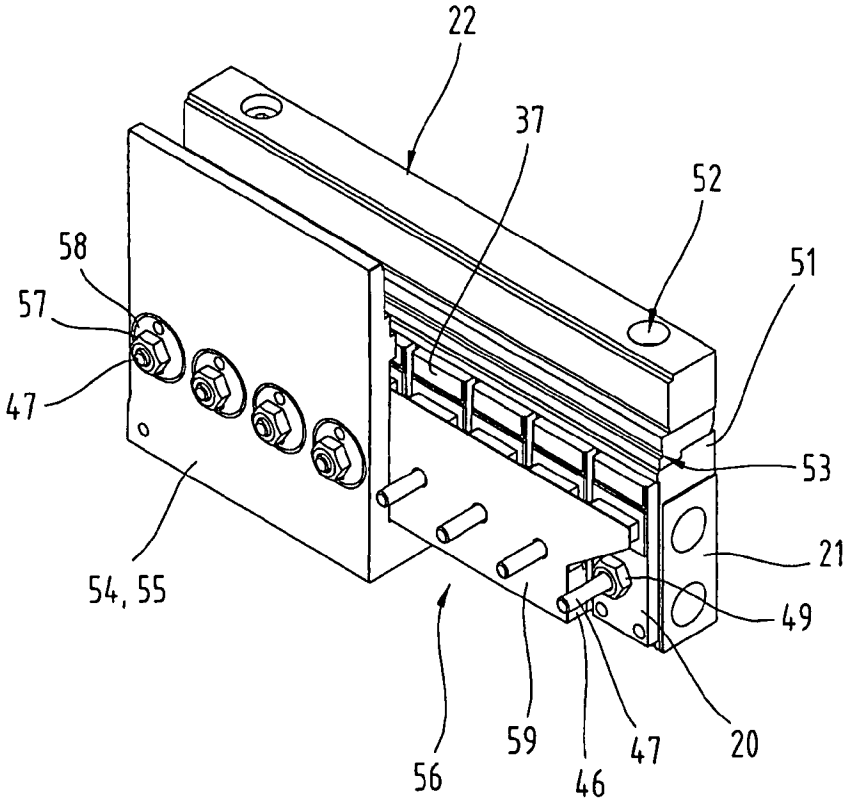
FIG. 5 shows a completely assembled diode laser insert according to embodiment in the FIGS. 3 and 4 with partly assembled housing members.

FIG. 5 shows another phase of assembly of a possible embodiment of a diode laser insert 22 according to the invention according to FIGS. 3 and 4, as it can be used in a bending die 3 according to FIGS. 1 and 2.

After the assembly of the diagonal connection elements 46, the front side of the diode laser insert 22 is closed housing-like by securing a housing cover 54 by means of the fixing screws 47 protruding the diagonal connection element 46. Said housing cover 54 surrounds the diode laser bars 20 together with the carrier element 21 housing-like and has, after these two elements together, an upwards leading, slot-shaped opening, the radiation 18 can remove through upwards into the direction of the workpiece 2. In the exemplary embodiment, the housing cover 54 can especially be such embodied that it comprises two cover halves 55 and 56 being electrically isolated from each other but in FIG. 5 only the first cover half 55 is shown. These two cover halves 55 and 56 can be made of an electrically conductive metal and can be used for connection to the power supply by electrically conductive connection between the left cover half 55 and the negative terminal 40 of the most left diode laser bar 20 as well as electrically conductive connection between the right cover half 56 and the positive terminal 38 of the most right diode laser bar 20. Thus, the cover halves 55 and 56 can for example have an L-shaped cross section and the lower horizontal leg is a contact surface for the carrier element 21 and this lower horizontal leg is flush with the rear side 48 of the carrier element 21, with the result that an essentially block-shaped diode laser insert 22 is created. Due to this assembly of a diode laser insert 22, carrier element 21, diode laser bar 20, diagonal connection elements 46, housing member 54, particularly the cover halves 55 and 56 by means of the fixing screws 47, the female screws 49 and further female screws 57 or equivalent connections can be arranged to be a compact diode laser insert 22, which is easily dismountable on demand and allows the exchange of single components. For a reliable, galvanic separation of the fixing screws 47 and the cover halves 55 and 56, electrically isolating washers 58 are arranged underneath the further female screws 57. Additionally, further isolating components are provided as galvanic separation between the diagonal connection elements 46 and the cover halves 55 and 56, for example as shown in the exemplary embodiment according to FIG. 5, an insulating plate 59 made of electrically non-conductive plastics.

Figure 6:
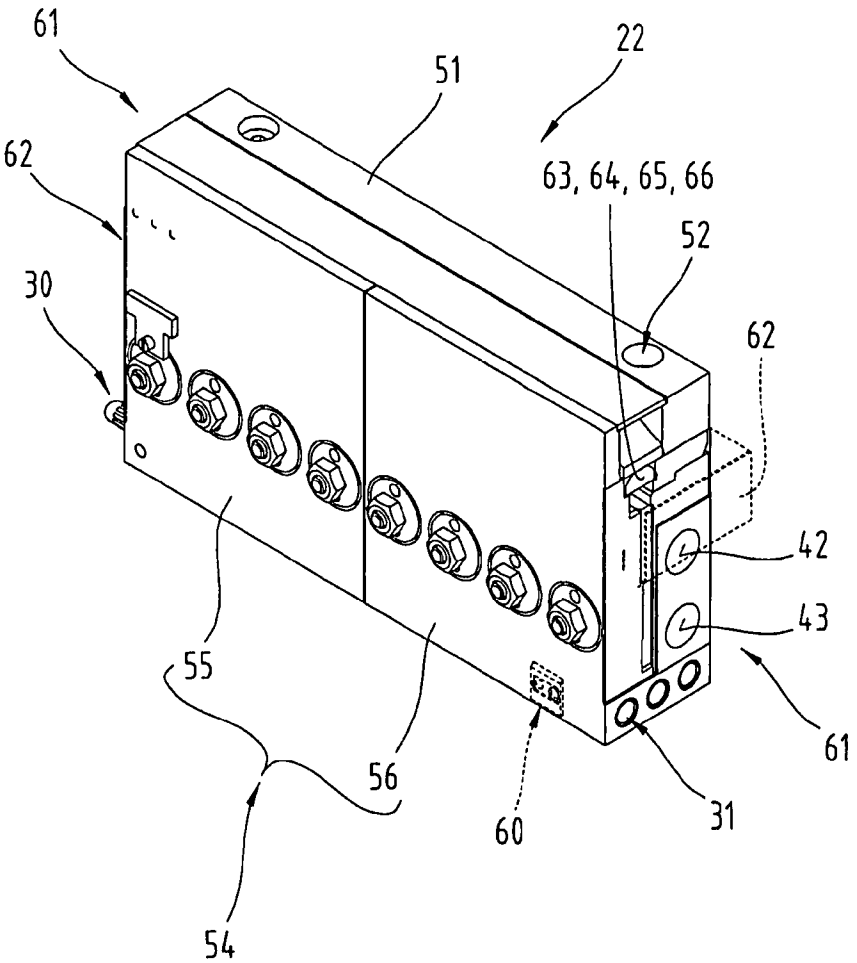
FIG. 6 shows a completely assembled diode laser insert according to the FIGS. 3 to 5.

FIG. 6 shows a diode laser insert 22 that is completely assembled to be a unit and is applicable for the installation into a tool base body 7 according to FIG. 1 or 2. In this exemplary embodiment, the electrical connections for the power supply of the diode laser bars 20 connected in series are embodied inside the diode laser inserts 22 at the front side in form of connection terminals 60 and a connection terminal 60, schematically shown in FIG. 6, that can be used to realize a power connection to a terminal die. Between adjacent bending dies 3 the transmission of current is preferably effected via the plug connections 30 and 31. In FIG. 6, the diode laser insert 22 is closed at the front side by means of a first left cover half 55, electrically connected to the negative terminal 40, and the second, right cover half 56, connected to the positive terminal 38. Additionally, end plates 62 or end foils for closing the diode laser insert 22 in axial direction dustproof are fixed to the axial front sides 61. In this case, the end plates 62 can be glued to front sides 61 of the carrier element 21 and the housing element 54 or clamped against said front sides 61 by means of screws or an adjacent bending die 3.

FIG. 6 furthermore shows a collimation lens 63 arranged between the retaining ledge 51 and the cover halves 55, 56, with the collimation lens 63 being made of a material being permeable to laser radiation 18, that means glass or suchlike, that is used to compensate the beam widening inevitable appearing in the beam path and thus the heating of the workpiece 2 in the narrowly limited section in the area of the deformation zone is effected by laser irradiation. Particularly one or several cylindrical lenses 64, the axis of curvature of which extends parallel to the bending recess 11 or the bending line 15 can be provided as collimation lenses 63. Because in the case of diode laser bars 20 of the generic kind, the beam widening transversely to the beam propagation plane, in this exemplary embodiment according to the bending plane 14, can take very high values of more than 30°, these collimation lenses 63 allow a positioning of the diode laser bars 20 with a larger distance to the contact surface 10, because the strong beam divergence is compensated by the collimation lens 63 and also in the case of larger distance between the diode laser bars 20 and the workpiece 2 bearing again the contact surface 10, the high radiation density is remained in existence. Alternatively or additionally to the collimation lenses 63 being arranged separated from the diode laser bars 20 it is possible to use diode laser bars 20 that provide a collimation lens directly on their beam exit area 25 and in this case, particularly GRIN lenses (Gradient-index) can be used, which do not achieve their focusing effect by a curved surfaces but by the variation of their refraction index over their thickness. In this case, these collimation lenses for the Fast-Axis-Collimation can be mounted at a distance from the diode laser bars 20. Thus, no optimal collimation is achieved, though, but a focusing of the radiation in front of the undeformed workpiece 2 is effected by positioning the focus below the contact surface 10, with the result that radiation probably emitting from the bending die 3 is diverged as quickly as possible.

The top side of the diode laser insert 22 can additionally be closed by means of non-reflecting, plane-parallel glass plates to ensure a dustproof housing of the diode laser bars 20.

Figure 7:
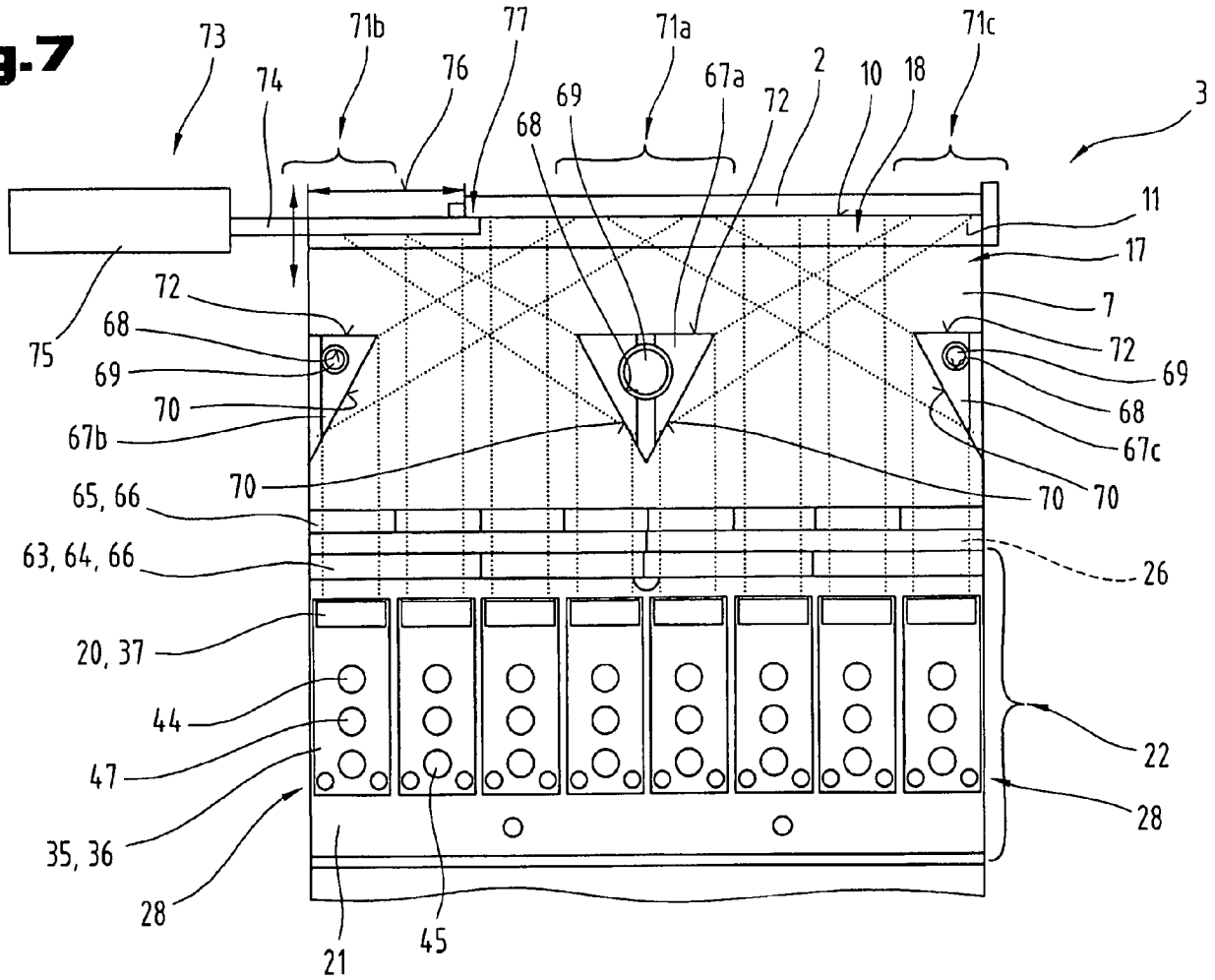
FIG. 7 shows a section view through a bending die in another form of embodiment with schematic presentation of the beam carrying within the bending die.

As another exemplary embodiment, FIG. 7 shows a section view through a bending die 3, in which a diode laser insert 22, for example in the embodiment according to FIGS. 3 to 6 but also in modified form thereof, can be used. The diode laser insert 22 is not described in more detail at this place and with respect to the components equipped with reference numerals it is referred to the descriptions of the FIGS. 3 to 6. The diode laser insert 22 according to FIG. 7 also comprises eight diode laser bars 20 arranged one next to each other, what causes that eight planar fanned beams 26 next to each other and at least being approximately extending within the bending plane 14 originate from it. Highly simplified, the tool base body 7 is U-shaped, with the upper opening of the U corresponding to the bending recess 11, where the workpiece 2 is pressed into during the deformation and where the before and during the process of deformation, laser radiation 18 for the heating of the workpiece 2 is inserted through the beam exit opening 17. The diode laser insert 22 is arranged in the lower area of the recess of the U-shaped tool base body 7 and has connection interfaces 28 for the supply with electrical current for operating the diode laser bars 20 and for coolant for removal of heat losses. After having passed the collimation lenses 63 or the cylindrical lenses 64, the planar fanned beams 26 emitted by the diode laser bars 20 are additionally affected by means of further correction lenses 65, with either the beam widening within the beam propagation plane being reduced or increased, too. In this case, the correction lenses 65 can be embodied as cylindrical collecting lenses or diverging lenses. The collimation lenses 63 and the correction lenses 65 can generally be referred to as beam forming elements 66 that affect the planar fanned beams 26 in their path. In the exemplary embodiment shown, the beams of the planar fanned beams 26 extend approximately parallel in the direction of the workpiece 2.

For increasing the mechanical stability of the bending die 3, spacer elements 67 are provided between the diode laser insert 22 and the beam exit opening 17 that are arranged between the towering and unengaged legs of the essentially U-shaped tool base body 7 and with which the legs of the U-shaped tool base body 7 are clamped together. For this purpose, the spacer elements 67 and the tool base body 7 have for example through holes 68 being aligned with each other which are projected through by clamping screws 69 or snap-in elements and which are used to clamp or fix the both legs of the U-shaped tool base body 7 against the spacer elements 67 by means of screw connections. The tool base body 7 thus obtains a high, mechanical stability and the unengaged legs of the U-shaped tool base body 7 are not or only insignificantly forced apart due to the forces arising from the bending process.

These spacer elements 67 for mechanical stabilization of the bending die 3 that are arranged above the radiation source in form of the diode laser bars 20, are situated in the beam path of single planar fanned beams 26 and a workpiece 2 could not be heated or sufficiently heated in the deformation zone 16 area above said spacer elements 67 to execute the bending with a good bending result. In order to be able to heat the sections of the deformation zone 16 being situated above the spacer elements 67 by means of laser radiation 18 anyway, the spacer elements 67 have reflection faces 70 being oriented diagonally to the laser radiation 18 incoming from the diode laser bars 20. At said reflection faces 70, the laser radiation 18 incoming from the diode laser bars 20 is deflected to the area shadowed by an adjacent spacer element 67 within the deformation zone 16. As adumbrated by single beams in the border area of the planar fanned beams 26 in FIG. 7, the laser beams hitting the middle spacer element 67*a* are deflected to the shadowed area 71*b* effected by the left spacer element 67*b* by the reflection faces 70 of the middle spacer element 67*a* or are deflected to the shadowed area 71*c* caused by the right spacer element 67*c*. Thus, laser radiation 18 for heating a workpiece 2 is available also in these areas. In return, the laser radiation 18 hitting the left spacer element 67 is deflected by its reflection face to the shadowed area 71*a* of the middle spacer element 67*a*, as well as the laser radiation 18 of the right spacer element 67*c* by its reflection face 70. Due to this measure it is possible to mechanically stabilize a bending die 3 or its tool base body 7 by means of clamping elements, as there are for example the described spacer elements 67 in connection with clamping screws 69, a tool base body 7 in the area between the radiation source for generating laser radiation 18—in this case the diode laser insert 22—and the bending recess 11, without having areas within the deformation zone 16 where is not sufficient radiation density. The reflection faces 70 are preferably provided with an reflective coating, to ensure that preferably the entire incoming radiant power is deflected to the adjacent shadowed areas 71 and the spacer elements 67 absorb the least possible radiation energy and thus heat. Additionally, also the top sides 72 of the spacer elements 67 can be embodied with an reflective coating, with the result that the laser radiation 18 reflected by the workpiece 2 is led back to it and thus also is available for the heating of the workpiece 2.

The reflection faces 70 of the middle spacer element 67*a* can be embodied slightly buckled to concentrate the radiation 18 of the corresponding laser diode bar 20 in the border area in a way that the intensity on the bending line 15 at the end of the die tends to approach zero.

Similar things are also thinkable for the spacer elements 67*b* and 67*c*, because the planar fanned beams 26 hitting them and being reflected by them overlap each other in the middle shadowed area 71*a*.

Alternatively to the buckled reflection faces 70 curved surfaces can be used for this purpose, what can have advantages with respect to manufacturing.

FIG. 7 furthermore shows an embodiment of a bending die 3 with a shielding device 73 that can also be used with other embodiments of the bending die 3 and that serves for optically closing areas of the bending recess 11 that are not covered by the workpiece 2 and thus to avoid the discharge of laser radiation 18 that would not hit a workpiece 2. The shielding device 73 essentially comprises a shielding element 74 that is adjustable in longitudinal direction 27 of the bending recess 11 by means of an adjustment device 75. This shielding element 74, that can also be referred to as slider or slipcase, screens the section 76 of the bending recess 11 that is not covers by the workpiece 2, with the result that the laser radiation 18 is prevented from discharging from the bending die 3. The laser radiation 18 emitted via the beam exit opening 17 into the bending recess 11 is in this case at least partially absorbed by the shielding element 74 or reflected back into the interior of the bending die 3. The bottom side of the shielding element 74 can have an optically diverging surface, with the result that the reflected radiation keeps decreasing and is spread over large areas of the interior of the die.

By means of the adjustment device 75, the shielding element 74 can be adjusted to different dimensions of the workpiece 2. It can be ensured that the shielding element 74 bears against the workpiece 2 to be bent by the fact that the shielding element 74 is approached to the workpiece 2 using a certain minimum force, with the additional possibility that a mechanical, electrical or optical query of the contacting of the workpiece and thus of the complete shielding of the section 76 can be ensured. This can for example be effected by the fact that the shielding element 74 has a check ark 77 at its end of the top side facing the workpiece 2 and the check mark 77 is supervised by a camera, not shown, mounted above the bending die 3. In case of a relocation of the check mark 77 at the shielding element 74 below the edge of the workpiece 2, the check mark 77 cannot be detected anymore, from which is deducible that the shielding element 74 rests against the workpiece 2. In this case, the end section with the check mark 77 has a notch in the area of the bending line 15 to allow that it can also be irradiated by the laser radiation at the edge of the workpiece 2. Additionally, the shielding element 74 or the entire shielding device 73 can be mounted moveable in the direction of the double arrow in FIG. 7, what causes that it can be pressed together with the workpiece 2 into the interior of the bending recess 11 during the execution of a bending process without restraining the bending process. The shielding element 74 can particularly be guided with vertical motion clearance in guiding grooves in the tool base body, what causes that no direct discharge of laser radiation along the lateral guiding faces of the shielding element 74 can be effected.

Figure 8:
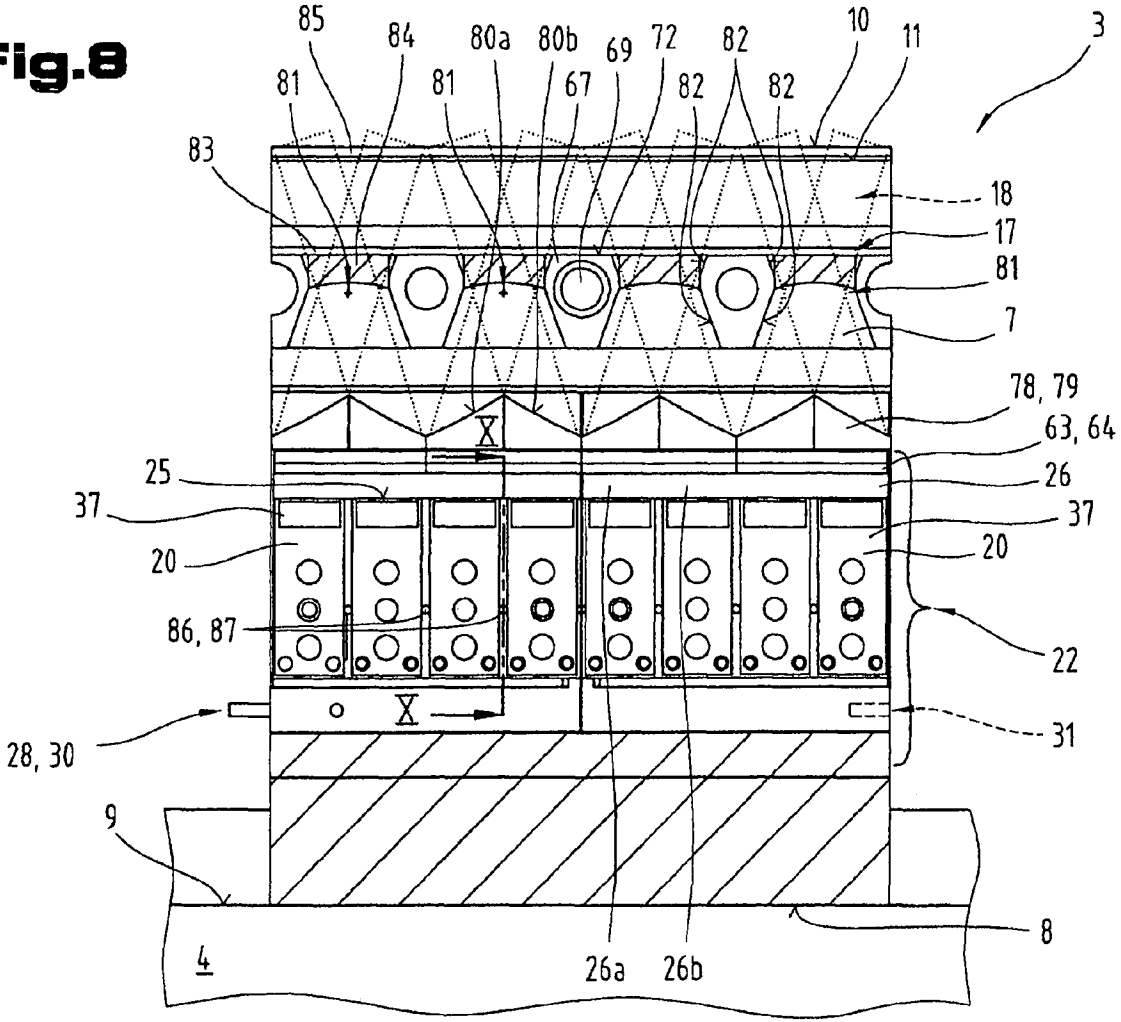
FIG. 8 shows a section view through the bending die in another form of embodiment with a schematic presentation of the beam carrying within the bending die.

FIG. 8 shows another possible embodiment of a bending die 3 with several diode laser bars 20 that are arranged one next to the other along the bending recess 11 in the interior of the tool base body 7 and the respective laser diodes arrangements 37 emit a planar fanned beam 26 that is at least approximately situated in one plane with the other planar fanned beams 26. To avoid a beam widening transversely to the beam propagation plane, the planar fanned beams run through a collimation lens 63 in form of a cylindrical lens 64 with the result that the laser beams essentially spread within a common beam plane. Similar to the exemplary embodiment according to FIG. 7, also in this exemplary embodiment of a bending die 3, spacer elements 67 are arranged between the diode laser bars 20 and the bending recess 11, with said spacer elements 67, the opposite sections of the tool base body 7 surrounding the diode laser bars 20 or the diode laser insert 22 can be clamped together, for example by using a clamping screw 69, what causes an substantially increased mechanical stability of the bending die 3. Due to the fact that the spacer elements 67 would cause upwardly straight-lined shadowed areas if the planar fanned beams 26 run vertically, also in case of this embodiment measures are provided to avoid such shadowed areas with low heat input. In case of this embodiment, the largest part of the laser radiation 18 or preferably the entire laser radiation 18 is guided past these spacer elements 67 to the bending recess 11 by using beam control devices 78. For this purpose, by using for example prisms 79 or prism-like, optical components, the planar fanned beams 26 are so deflected in their direction as to extend between adjacent spacer elements 67 in the direction of the bending recess 11. For this purpose, the planar fanned beams 26 are diverted at an angle of preferably between 15° and 30° with respect to the direct vertical direction, whereby the deviation is achieved by alternating arrangement of the beam deflectors 78. As the example shows, the arrangement of the beam deflector devices 78 can be alternating left and right.

As it can be seen in FIG. 8, the planar fanned 26*a* is deflected to the right by a top face of prism 80 being tilted to the left and a planar fanned beam 26*b* thereto adjacent is deflected to the left by atop face of prism 80*b* tilted to the right. The two planar fanned beams 26*a* and 26*b* or their radiation maximum thus cross each other at a crossover point 81, that in the exemplary embodiment shown is situated circa at half height between the prisms 79 and the contact surface 10 for the workpiece 2. Four planar fanned beams 26 being next to each other passing through four beam deflection devices 78, in this case in form of prisms 79, thus result in crossover points 81 spaced apart from each other, where the laser radiation has its maxima. Between these crossover points 81, the intensity of the laser radiation strongly decreases and thus the spacer elements 67 are preferably arranged in the center between the crossover points 81. The relatively small part of the radiation hitting the spacer elements 67 can additionally be further reflected into the direction of the bending recess 11 by means of reflection faces 82, with the result that the laser beam performance absorbed by the spacer elements 67 is reduced further and the laser performance emitted by the diode laser bars 20 is guided to the deformation zone 16 of a workpiece 2 to be heated with the least losses possible. Like the reflection faces 70 according to the exemplary embodiments FIG. 7, the reflection faces 82 can be embodied with a reflective coating, too. The spacer elements 67 can be embodied as proper components but it is also possible that they are integrally connected to at least one leg of the U-shaped tool base body 7. According to the exemplary embodiment according to FIG. 7, the top side 72 of the spacer elements 67 can be embodied with a reflective coating or reflecting, too, to allow a laser radiation 18 reflected by a workpiece 2 being reflected upwards into the direction of the workpiece 2 again.

The exit and entry areas at the prisms 79 can also be embodied curved to realize an additional beam widening, collimation or focusing by one optical element. Particularly, the exit areas at the top sides of prisms 80 can be curved like a diverging lens, to ensure a more even distribution of intensity along the bending line 15.

It is furthermore of advantage if the beams in both embodiments in FIG. 7 and FIG. 8 are so crossed as to the area of an approximately homogenous line heating that means the area having the most even distribution of intensity, in FIGS. 7 and 8 being situated exactly on the bending line 15, is situated noticeably below the contact surface 10 or the bending line 15 of the undeformed workpiece 2, because the deformation zone moves downwards during the deformation and a homogenous heat application and an even heating of the workpiece is rather required in the end of the bending process at high bending temperatures that means more downwards in the bending recess 11.

It can furthermore be of advantage that between the diode laser insert 22 and the bending recess 11 or the spacer elements 67 and the bending recess 11 a covering plate 83 being permeable to laser radiation is arranged, which protects the interior of the bending die 3 against the entry of dust or other contaminations and which is, due to a smooth surface, easy to clean, for example through the beam exit opening 17 and thus the generated laser radiation 18 can be guided to a workpiece 2 with the least possible losses. When using such a covering plate 83 it is possible to connect it directly to the top sides 72 of the spacer elements 67 and to embody the areas above the spacer elements 67 with a reflective coating, too, to allow that laser radiation reflected downwards by the workpiece 2 is deflected into the direction of the workpiece 2 and thus a largest possible part of the radiant power generated is transmitted to the workpiece 2 in the area of the deformation zone 16. Similarly, a clear covering plate being component of the diode laser insert 22, can be provided in the path of the beams, directly following the last effective beam affecting means. Thus, a contamination of the beam exit areas 25 or the faces of following optical elements can be avoided in case of storing or operation.

The tool base body 7 of the bending die 3 in the exemplary embodiment according to FIG. 8 also has an exterior geometry comparable to conventional bending dies and can thus be used on conventional trimming presses and bending presses for the same bending geometries or workpiece dimensions like conventional bending dies.

FIG. 8 furthermore shows a connection interface 28 for the supply of the diode laser bars 20 with current in form of at least one plug connection 30, which is used to establish the power connection to the insertion opening 31 of an adjacent bending die 3. Plug connectors 30 and insertion openings 31 are in this case arranged in the metallic cover halves 55 and 56 (see FIG. 6), which can entirely make up a terminal and have a contact press face to the first negative terminal 40 (see FIG. 4 very left) or to the last positive terminal 38 formed by the microchannel cooler 36*b* (see FIG. 4 very right). As furthermore shown in FIG. 8, further diverging lenses 84 can be arranged in the beam path of the laser radiation, which can be used to further expand the planar fanned beams 26 within the beam propagation plane and thus the radiant power emitted by the diode laser bars 20 can be spread more evenly in the area of the bending recess 11. For this purpose, diverging lenses 84 are cylindrical and have an axis of curvature right-angled to the beam propagation plane, with the result that the planar fanned beams 26 are not expanded transversely to their propagation plane and this is situated at least approximately within the bending plane 14.

The diverging lenses 84 can additionally be operate or embodied as spacer elements 67, too, with the result that their expansion can be strongly enlarged while simultaneously minimizing the size of the shadowing elements, which are usually reduced to clamping screws 69 or locking elements. Alternatively, the locking elements can have corresponding recesses, ensuring a defined distance between the spaced halves of the tool—made up of the legs of the tool base body 7. The locking elements can be independent elements as well as constructed integrally together with a half of the tool.

Due to their planar fanned beams 26 crossing each other, the spacer elements 67 in the exemplary embodiment according to FIG. 8 have an approximately rhombic basic shape, with the longer symmetrical axis of the rhombus extending approximately in vertical direction and the apexes facing the diode laser bars 20 and the bending recess 11 are flattened.

The extensive deflection of the planar fanned beams 26 past the spacer elements 27 shown in FIG. 8, can also be similarly applied to an embodiment according to FIG. 7, with the reflection faces 82 or 70 being so embodied in this case, as to the radiation reflected by these areas is also guided at least approximately into a shadowed area 71 above one spacer element 67.

Because the heat application into the deformation zone 16 of the workpiece 2, effected by the laser radiation, expands within the workpiece 2 due to natural processes of heat conduction, and thus parts of the heat energy also discharge into the bending die 3 accelerating the further heat removal from the deformation zone 16, it is furthermore possible to equip the contact face of the bending die 3 with an insulating layer 85 made of a material having a lower coefficient of heat conductivity than the tool base body 7, for example PEEK plastics, other plastics, ceramics or metals. This is also possible in case of other exemplary embodiments, particularly according to FIGS. 1, 2 and 7.

With respect to the mode of operation and the design of the diode laser insert 22 it is referred to the description of the above mentioned FIGS. 1 to 7 to avoid redundant repetitions.

The diode laser bars 20 assembled into a bending die 3 according to the invention are assembled in such a number into the interior of the tool base body 7 as to allow the discharge of laser radiation for heating the deformation zone 16 preferably throughout the whole length of the bending recess 11 of the bending die 3. Nevertheless, because the bending length of a workpiece 2 does not always equal the total length of a bending die 3, but can be shorter, it is furthermore advantageous if the laser radiation 18 can be adjusted to the bending length of a workpiece 2 by selectively enabling single or several of the diode laser bars 20. Depending on the electrical connection of the diode laser bars 20 used, there are different possible solutions for enabling single or several diode laser bars 20. If they are connected parallel to the power supply, each diode laser bar 20 can be equipped with an own switching element, with the result that each diode laser bar 20 can be enabled or disabled independent from the remaining diode laser bars 20. In this case, the switching elements can for example be switchable manually as well as by means of electrical switches, relays or suchlike by means of a control device.

If the diode laser bars 20, as described in previous exemplary embodiments, are connected in series, single diode laser bars 20 cannot be disabled by opening a switch, but they have to be bypassed by appropriate contact elements 86, with the result that the operating current flows through the contact element 86 instead of the diode laser bar 20 to be disabled. Using the contact elements 86, a direct electrical connection between the appropriate positive poles or negative poles of adjacent diode laser bars 20 or microchannel coolers can be set up, with the result that the current is directly led to the next diode laser bar 20 or microchannel cooler and is not led via the laser diodes arrangement 37. The corresponding laser diodes arrangement 37 is in this case disabled and no laser radiation is emitted by this diode laser bar 20.

Figure 9:
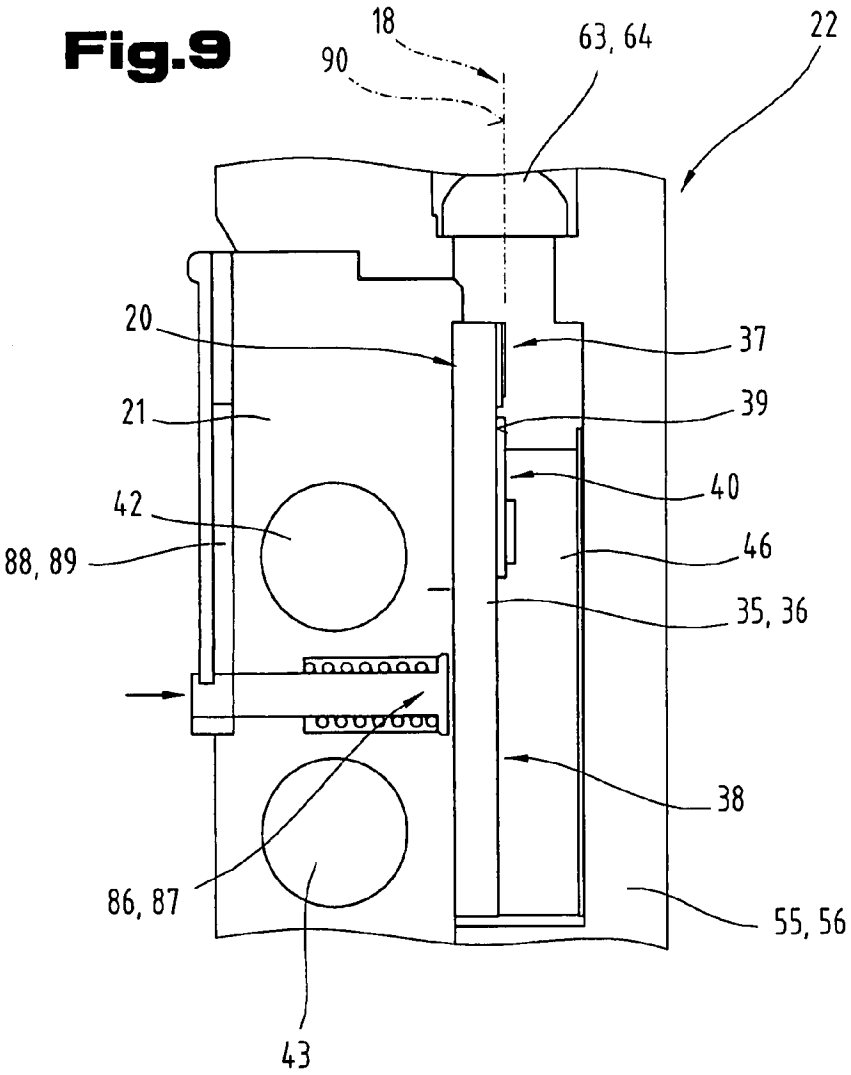
FIG. 9 shows a section view through a diode laser insert with means for inactivating single diode laser bars applicable for being inserted in a bending die according to FIGS. 1, 2; 6; 7; 8; 10.

A possible exemplary embodiment for such contact elements 86 is shown in FIG. 9, showing a section view through a diode laser insert 22 according to exemplary embodiment in FIG. 8. As already described on the basis of FIGS. 2 and 3, the diode laser bars 20 are arranged on a common carrier element 21 and connected in series by means of the diagonal connection elements 46. In the exemplary embodiment according to FIG. 9, the contact elements 86 for deactivating single laser bars 20 are embodied by contact pins 87 with plate-like end sections, which, as shown in FIG. 8, are positioned between adjacent diode laser bars 20 and project from the direction of the rear side 48 into the carrier element 21, inside of which they also are mounted adjustably in the direction of their longitudinal axis. For deactivating a single diode laser bar 20, a contact element 86 is so adjusted as to electrically conductively connect corresponding terminals of a diode laser bar 20, with the result that the operating current cannot low through the appropriate laser diodes arrangement 37 anymore, but is directly led to the corresponding pole of the adjacent diode laser bar 20.

In FIG. 9, the end section of the contact element 86 or the contact pin 87 is slid against the rear side of two microchannel coolers 36, which each represents a positive terminal for the supply of current of a laser diodes arrangement 37. The current is thus not transmitted to the next positive terminal via a diagonal connection element 46 and the laser diodes arrangement 37, but directly via the contact element 86, with the result that the appropriate laser diodes arrangement 37 does not emits laser radiation due to a lack of supply current. The adjustment of the contact element 86 in the form the contact pin 87 is advantageously effected by a piezo actuator 88, in the exemplary embodiment FIG. 9 by a bending piezo actuator 89 that can adjust a respective contact element 86 between a neutral position and a bypassing position.

A contact element 86 in the form of a contact pin 87, having a tapered form at its end section, has turned out to be especially reliable and inured to position and shape tolerance of the elements participating in the conduction of current and easy to produce. At the level of the bending piezo actuator 89, the pin has a recess or another appropriate design, which the piezo bending element engages and is for example glued to with glue being resistant to high temperatures. Other elements, for example a spring, can thus be omitted, because the basic position is effected by the bending element of the piezo actuator. The adjustment axis of the contact pin 87 and its tapered ending are positioned between two adjacent microchannel coolers 36. If the bending element of the piezo actuator moves into the direction of the microchannel cooler 36 (adumbrated by an arrow), the contact pin 87 necessarily touches both and short-circuits them.

The tapered ending can also be situated between cover half 56 and a microchannel cooler 36. This is especially applicable for the partial switch-off of the last diode laser bar 20, which does not have an appropriate adjacent diode laser bar 20. In this case, the taper must have a large contact face to the housing, because this is not cooled. If applying this method to central microchannel coolers, it is possible to disable or deactivate all diode laser bars 20 being situated in flow direction of the current before this diode laser bar 20 36 additionally and at the same time by means of a contact element.

The tapered ending of a contact element 36 can also be positioned between the cover halves 55 and 56 and can deactivate all diode laser bars 20 at once in this embodiment. It is alternatively also possible to set up the bypassing between adjacent negative terminals 40 but also between adjacent diagonal connection elements 46. The arrangement of the contact elements 86 and of the piezo actuators adjusting them can also be provided at other positions. The operational voltage of the piezo actuators has a range of about +/−30 Volts, because of which they are equipped with an own supply of current and additional control lines.

Furthermore, the beam plane 90 of the laser radiation 18 emitting from the diode laser insert 22 is adumbrated in FIG. 9. In the simplest case, said beam plane 90 coincides with the bending plane 14. The beam plane 90 can also be slightly tilted away from the operator by a marginal relocation or tilting of the FAC lenses 63, 64 so that radiation probably emitting rather expands into the bending machine, that means away from the operator.

As already described on the basis of FIG. 2, bending dies 3 according to the present invention can be assembled to be a die arrangement 91 by means of sequencing them in longitudinal direction of the bending line 15. This die arrangement 91 comprises the bending dies 3*a*, 3*b*, . . . directly stringed together that are each embodied according to the invention. This is especially facilitated due to the fact that they have already described connection interfaces 28 for coolant and/or operating current and/or control current and the connection interfaces 28 particularly comprise plug connections 30. An arrangement of the plug connection elements 30 at the axial end face areas 29 of the tool base body 7 or the diode laser inserts 22 is especially advantageous in this case. The bending dies 3 according to the invention thus allow the adjustment to the dimensions of a workpiece 2 by partial deactivation of diode laser bars 20 to deactivate sections 76 of a bending die that are not covered by a workpiece 2 and the stringing together of several bending dies 3 to be a die arrangement 91 to bend workpieces the bending length of which exceeds the total length of one single bending die 3.

Figure 10:
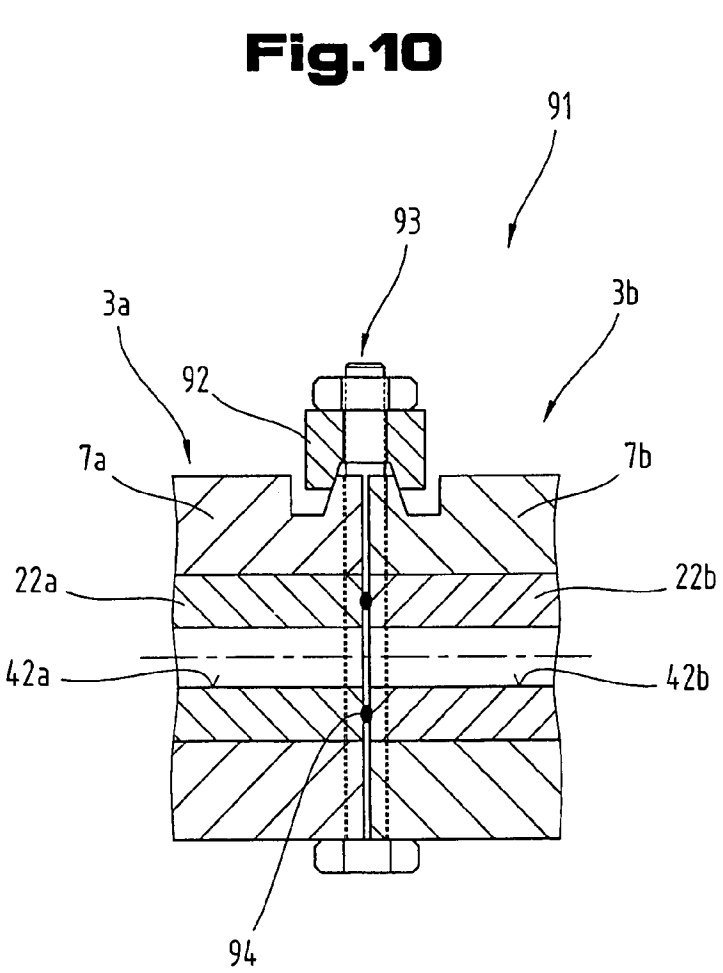
FIG. 10 shows a section view through two aligned bending dies of a die arrangement with means for a mutual axial clamping and a possible embodiment of a connection interface for coolant.

FIG. 10 shows a section view through a joint between two adjacent bending dies 3*a* and 3*b* according to the invention along the line IX-IX in FIG. 9. The end face areas of the diode laser inserts 22*a* and 22*b* face each other, with the result that corresponding channels for coolant 42*a* and 42*b* are positioned opposite each other. At least one of the opposite front face areas is equipped with a sealing, for example in the form of an O-ring, that arranges the sealing of the joints when the front face areas are pressed together axially.

The axial clamping relative to one another can also be effected by a clamping device extending over all bending dies. A connection by means of an axial tensioning element 92, for example embodied U-shaped and engages flutes embodied on the bending dies 3*a* and 3*b*, is nevertheless of particular advantage. By tapered, corresponding clamping surfaces tilted towards each other situated at the axial tensioning element 92 as well as at the flutes of the bending dies 3*a* and 3*b*, an axial clamping force can be generated by means of a clamping screw 93 that pulls the axial tensioning element 92 towards the joint in radial direction. Said axial clamping force strongly clamps the bending dies 3*a* and 3*b* to one another and an O-ring 94 being arranged in between can fulfill its sealing effect. For this purpose it is necessary that the diode laser inserts 22 are connected to the respective tool base body 7 axially immovably and virtually free of clearance. Advantageously, the axial tensioning element 92 can be equipped with a thread so as to the screw can be directly screwed to it. Derogating from the embodiment in FIG. 10, the exterior side of an axial tensioning element 92 in an assembled state can be at least approximately flush or planar with the rear side of the die, with the result that it does not create problematic geometries for bending processes. Furthermore, an additional clamping element 93 with a trough hole can be arranged at the opposite side, in this case the front side with the screw head, so as to clamp also the front sections of the tool base body 7 directly with each other when tightening the clamping screw 93.

Alternatively, a diode laser insert 22 can also be arranged complete or partial slidable in the bending die 3. Only one permanent joint between the bending dies 3 is established by the clamping arrangement of FIG. 10. In order to press the diode laser inserts axially to one another anyway, clamping adapters are screwed to the both front sides of the tool base body (7). The clamping adapters have press areas corresponding to the front sides of the diode laser inserts 22, so as to axially press together all diode laser inserts 22 lying in between when screwing on these clamping adapters. These clamping adapters can preferably be embodied to be adapters for the current and cooling water lines at the same time and can thus also be connection interfaces 28 for the supply of the bending dies 3.

In FIG. 1, another advantageous embodiment of a bending die 3 according to the invention is adumbrated. In this case, the tool base body 7 comprises a die adapter 95 making up the contact surface 10 and the bending recess 11. The die adapter 95 is arranged exchangeable at the remaining section of the tool base body 7 containing the diode laser bars 20. Thus, the tool base body 7 can be adjusted to different bending tasks by exchange of the die adapter 95, particularly the die width can be changed. In this case, the die adapter 95 can be embodied in two parts, with a corresponding part of the adapter being mounted before as well as behind the bending plane 14. However, an embodiment with the spacer elements 67 being component part of the die adapter 95 and this thus being embodied to be a mechanical stable unit, is advantageous.

The exemplary embodiments show possible variants of embodiment of the bending die 3 and are not intended to limit the scope of the invention to these illustrated variants of embodiments provided herein but that there are also various combinations among the variants of the embodiments themselves and variations regarding the present invention should be executed by a person skilled in the art. All and every imaginable variants of the embodiment, arising from combining single details of the variant of embodiment illustrated and described are subject to scope of protection.

Finally, as a point of formality, it should be noted that for a better understanding of the structure of the devices according to the invention the latter and their components have not been represented true to scale in part and/or have been enlarged and/or reduced in size.

The problem addressed by the independent solutions according to the invention can be taken from the description.

Mainly the individual embodiments shown in FIGS. 1; 2; 3, 4, 5, 6; 7; 8; 9; 10 can form the subject matter of independent solutions according to the invention. The objectives and solutions according to the invention relating hereto can be taken from detailed descriptions of these figures.

| List of Reference Numerals | |
|---|---|
| 1 | Bending tool arrangement |
| 2 | Workpiece |
| 3 | Bending die |
| 4 | Press beam |
| 5 | Bending punch |
| 6 | Direction of adjustment |
| 7 | Tool base body |
| 8 | Connection profile |
| 9 | Standard tool holder |
| 10 | Contact surface |

-continued

| List of Reference Numerals | |
|---|---|
| 11 | Bending recess |
| 12 | V-shaped groove |
| 13 | V-shaped die |
| 14 | Bending plane |
| 15 | Bending line |
| 16 | Deformation zone |
| 17 | Beam exit opening |
| 18 | Radiation |
| 19 | Bottom side |
| 20 | Diode laser bars |
| 21 | Carrier element |
| 22 | Diode laser insert |
| 23 | Die length |
| 24 | Bar width |
| 25 | Beam exit area |
| 26 | Planar fanned beam |
| 27 | Longitudinal direction |
| 28 | Connection interface |
| 29 | End face area |
| 30 | Plug connector |
| 31 | Insertion opening |
| 32 | Longitudinal axis |
| 33 | Fixing surface |
| 34 | Bar |
| 35 | Cooling element |
| 36 | Microchannel cooler |
| 37 | Laser diodes arrangement |
| 38 | Positive terminal |
| 39 | Insulation bed |
| 40 | Negative terminal |
| 41 | Contact plate |
| 42 | Supply channel for coolant |
| 43 | Outlet channel for coolant |
| 44 | Connecting bore |
| 45 | Connecting bore |
| 46 | Diagonal connection element |
| 47 | Fixing screw |
| 48 | Rear side |
| 49 | Female screw |
| 50 | Longitudinal axis |
| 51 | Retaining ledge |
| 52 | Screw connection |
| 53 | Retaining groove |
| 54 | Housing member |
| 55 | Cover half |
| 56 | Cover half |
| 57 | Female screw |
| 58 | Washer |
| 59 | Insulating plate |
| 60 | Connecting terminal |
| 61 | Front side |
| 62 | End plate |
| 63 | Collimation lens |
| 64 | Cylindrical lens |
| 65 | Correction lens |
| 66 | Beam forming element |
| 67 | Spacer element |
| 68 | Through hole |
| 69 | Clamping screw |
| 70 | Reflection face |
| 71 | Shadowed area |
| 72 | Top face |
| 73 | Shielding device |
| 74 | Shielding element |
| 75 | Adjustment device |
| 76 | Section |
| 77 | Check mark |
| 78 | Beam control device |
| 79 | Prism |
| 80 | Top face of prism |
| 81 | Crossover point |
| 82 | Reflection face |
| 83 | Covering plate |
| 84 | Diverging lens |
| 85 | Insulating layer |
| 86 | Contact element |
| 87 | Contact pin |

-continued

| List of Reference Numerals | |
|---|---|
| 88 | Piezo actuator |
| 89 | Bending piezo actuator |
| 90 | Beam plane |
| 91 | Die arrangement |
| 92 | Axial tensioning element |
| 93 | Clamping screw |
| 94 | O-ring |
| 95 | Die adapter |

The invention claimed is:

1. A bending die comprising a tool base body with a contact surface for contacting a workpiece to be bent by a bending punch, a groove-shaped bending recess in the contact surface and at least one beam exit opening in the bending recess and extending along thereof, which is configured to discharge high-energy radiation onto a workpiece bearing against the contact surface in order to heat the deformation zone of the workpiece, wherein an arrangement of diode laser bars is fixed in the interior of the tool base body for producing the radiation and said diode laser bars are arranged at least approximately uniformly along the longitudinal direction of the bending recess behind the beam exit opening in the tool base body.

2. The bending die according to claim 1, wherein the diode laser bars of the bending die are mounted on a carrier element and thus a connected diode laser insert is created, which is fixed in an exchangeable way in the tool base body.

3. The bending die according to claim 2, wherein the carrier element is made of plastics.

4. The bending die according to claim 2, wherein the carrier element is made of stainless steel.

5. The bending die according to claim 1, wherein the diode laser bars are connected in series.

6. The bending die according to claim 1, wherein a power connection between two adjacent diode laser bars from a positive terminal of the one diode laser bar to a negative terminal of the other diode laser bar is set up by a diagonal connection element.

7. The bending die according to claim 1, wherein switchable contact elements with which single diode laser bars of several diode laser bars connected in series can be deactivated by direct bypassing between corresponding positive terminals or negative terminals of adjacent diode laser bars are arranged in the bending die at a diode laser insert created by mounting the diode laser bars on a carrier element.

8. The bending die according to claim 7, wherein the contact elements are adjustable between a neutral position and a bypassing position by means of piezo actuators.

9. The bending die according to claim 7, wherein the contact elements can be positioned in the clearance between adjacent diode laser bars and are thereby electrically conductive between adjacent of diode laser bars electrically connected in series or effective between adjacent diagonal connection elements.

10. The bending die according to claim 7, wherein the contact elements have a tapered end section and this tapered end section can be axially slid in touching both terminals for deactivating a diode laser bar between two adjacent positive terminals or adjacent negative terminals.

11. The bending die according to claim 1, wherein at or behind a beam exit area of the diode laser bars, beam forming elements are arranged to effect Fast Axis Collimation.

12. The bending die according to claim 1, wherein at the tool base body an air connection with thereto following flow-path where purge air can be led through in an area of the bending recess between the workpiece and the beam exit opening or in an area between the workpiece and the diode laser bars or a diode laser insert created by mounting the diode laser bars on a carrier element.

13. The bending die according to claim 1, wherein the contact surface of the bending die has a lower thermal conductivity than the tool base body.

14. The bending die according to claim 1, wherein the tool base body is made of metal with a thermal conductivity that is lower than steel with 45 W/Km and/or with a coefficient of thermal expansion lower than steel with 0.00002 1/K.

15. The bending die according to claim 1, wherein the bending recess is elongated and the diode laser bars with their effective beam exit areas are arranged parallel to the bending recess, with the result that, directly of after passing beam forming elements and/or beam control devices, the beams emitted by a single diode laser bar of the diode laser bars essentially extend in a common beam plane from the beam exit opening to a bending line at a bottom side of the workpiece.

16. The bending die according to claim 1, wherein the beams of single or several diode laser bars are deflected within a beam plane by means of beam control devices.

17. The bending die according to claim 1, wherein the tool base body is embodied approximately U-shaped with the contact surface and the bending recess being arranged at an open ending of the U and the diode laser bars with their beam exit areas oriented towards the bending recess being fixed in the interior of the tool base body.

18. The bending die according to claim 1, wherein at least one spacer element and at least one clamping element clamping the tool base body against the at least one spacer element are arranged at the tool base body between the diode laser bars and the beam exit opening.

19. The bending die according to claim 18, wherein the at least one spacer element comprises a plurality of spacer elements and the laser radiation is guided by beam control devices at least approximately completely past the spacer elements to the beam exit opening.

20. The bending die according to claim 18, wherein a top side facing the workpiece of the at least one spacer element is embodied with a reflective coating.

21. The bending die according to claim 1, wherein the beam exit opening or the beam exit openings is or are each closed by a covering element impermeable to radiation.

22. The bending die according to claim 21, wherein the covering element comprises a diverging lens.

23. The bending die according to claim 1, wherein at least one adjustable shielding element for covering sections of the bending recess not covered by the workpiece is provided at the bending die between beam exit opening and contact surface.

24. The bending die according to claim 1, wherein the power emitted by the diode laser bars and/or the exposure duration of the radiation to the material and/or the geometrical dimensions of the workpiece to be bent can be adjusted by means of an electronic control device.

25. The bending die according to claim 1, wherein the tool base body at its end section facing away from the bending recess has a connection profile that can be held in a standard tool holder of a trimming press.

26. The bending die according to claim 1, wherein connection interfaces for connecting and/or transmitting coolant and/or operating power and/or control current are embodied at the tool base body or a diode laser insert created by mounting the diode laser bars on a carrier element.

27. The bending die according to claim 1, wherein the tool base body comprises a die adapter marking up the contact surface and the bending recess and is arranged in an exchangeable kind at a remaining section of the tool base body containing the diode laser bars.

28. A die arrangement comprising at least two bending dies directly stringed together in longitudinal direction of the bending line, wherein the bending dies are embodied according to claim 1.

29. The die arrangement according to claim 28, wherein at least one connection interface for coolant and/or operating power and/or control current is arranged in form of a plug connection at an axial end face area of the tool base body or a diode laser insert created by mounting the diode laser bars on a carrier element.

30. The die arrangement according to claim 28, wherein adjacent and aligned bending dies are combined to be a stringed together die arrangement by means of at least one axial tensioning element.

31. A method for bending a flat workpiece comprising:

(a) heating the workpiece in an area of a bending line locally via laser radiation discharging from a bending die;

(b) measuring the temperature at the bending line of the workpiece to create a measuring value during the heating by laser radiation;

(c) providing the measuring value to an electronic control device;

(d) using the electronic control device to initiate, accelerate or decelerate a bending process and/or increase, reduce or deactivate the laser radiation by activating or deactivating single or several diode laser bars according to the measuring value; and wherein the heating is effected using a bending die comprising a tool base body with a contact surface for contacting a workpiece to be bent by a bending punch, a groove-shaped bending recess in the contact surface and at least one beam exit opening in the bending recess and extending along thereof, which is configured to discharge high-energy radiation onto a workpiece bearing against the contact surface in order to heat the deformation zone of the workpiece, wherein an arrangement of diode laser bars is fixed in the interior of the tool base body for producing the radiation and said diode laser bars are arranged at least approximately uniformly along the longitudinal direction of the bending recess behind the beam exit opening in the tool base body.

32. The method according to claim 31, further comprising:

(a) before the application of radiation by the bending punch, subjecting the workpiece to a low, only elastic bending deformation and fixing the workpiece in a position so that only the heating by discharging radiation is activated at a bottom side of the workpiece;

(b) subsequently, beginning an activation of the radiation and continuing the deformation immediately or after expiring of a predetermined period of time, or when the workpiece in a deformation zone obtains a certain temperature; and (c) keeping the radiation activated until or shortly before the termination of the bending deformation.

* * * * *